US006993884B2

(12) United States Patent
Baranowski

(10) Patent No.: US 6,993,884 B2
(45) **Date of Patent: *Feb. 7, 2006**

(54) DISPENSING SYSTEMS AND METHODS

(75) Inventor: John Baranowski, Bensalem, PA (US)

(73) Assignee: Campell Soup Company, Camden, NJ (US)

( * ) Notice: Subject to any disclaimer, the term of this patent is extended or adjusted under 35 U.S.C. 154(b) by 0 days.

This patent is subject to a terminal disclaimer.

(21) Appl. No.: 10/601,674

(22) Filed: Jun. 24, 2003

(65) Prior Publication Data

US 2004/0007438 A1 Jan. 15, 2004

Related U.S. Application Data

(60) Provisional application No. 60/454,605, filed on Mar. 17, 2003, provisional application No. 60/390,364, filed on Jun. 24, 2002.

(51) Int. Cl.
*B65B 1/04* (2006.01)

(52) U.S. Cl. ..... 53/237; 53/235; 53/238; 53/240; 53/244; 53/251; 53/253

(58) Field of Classification Search ..... 53/473, 53/235, 237, 238, 240, 244, 250, 251, 253; 221/69, 82, 203, 200, 277; 141/144
See application file for complete search history.

(56) References Cited

U.S. PATENT DOCUMENTS

| | | | | |
|---|---|---|---|---|
| 3,578,094 A | | 5/1971 | Henry et al. | |
| 3,631,903 A | | 1/1972 | Huggins | |
| 3,696,584 A | | 10/1972 | Rickard | |
| 3,771,574 A | * | 11/1973 | Creed et al. | 141/1 |
| 3,782,878 A | | 1/1974 | Hudson | |
| 3,796,351 A | | 3/1974 | Kohl et al. | |
| 3,822,032 A | | 7/1974 | Vergobbi | |
| 3,828,869 A | | 8/1974 | Sellers | |
| 3,877,205 A | | 4/1975 | Gundersen | |
| 3,938,601 A | | 2/1976 | Hobart | |
| 4,004,620 A | * | 1/1977 | Rosen | 141/137 |
| 4,122,876 A | | 10/1978 | Nalbach | |
| 4,191,294 A | | 3/1980 | McGrath et al. | |
| 4,192,359 A | | 3/1980 | Pippin | |
| 4,193,465 A | | 3/1980 | Henry | |
| 4,248,027 A | | 2/1981 | Cleary et al. | |
| 4,385,670 A | | 5/1983 | Braun et al. | |
| 4,398,612 A | | 8/1983 | Mikami et al. | |
| 4,431,070 A | | 2/1984 | Andrews | |

(Continued)

FOREIGN PATENT DOCUMENTS

DE 900795 1/1954

(Continued)

OTHER PUBLICATIONS

PCT International Search Report (PCT/US03/19728), dated Oct. 17, 2003.

(Continued)

*Primary Examiner*—Scott A. Smith
*Assistant Examiner*—Brian Nash
(74) *Attorney, Agent, or Firm*—Baker Botts L.L.P.

(57) ABSTRACT

A dispensing system dispensing items includes a dispensing station and a first conveyor for transporting containers to the dispensing station. The dispensing station includes a dispenser for dispensing items to the containers, a mechanism for spacing the containers to a predetermined pitch, a transfer wheel for removing the containers from the first conveyor, a star wheel for receiving the containers from the transfer wheel and for transporting the containers in synchronization with the dispenser, and a turret for removing the containers from the star wheel.

27 Claims, 16 Drawing Sheets

U.S. PATENT DOCUMENTS

| | | | | |
|---|---|---|---|---|
| 4,456,117 | A | 6/1984 | Szczepanski | |
| 4,516,644 | A | 5/1985 | Fukuda | |
| 4,527,647 | A | 7/1985 | Ueda | |
| 4,534,428 | A | 8/1985 | Mosher et al. | |
| 4,534,429 | A | 8/1985 | Konishi | |
| 4,540,082 | A | 9/1985 | Maddocks | |
| 4,548,287 | A | 10/1985 | Matsuura | |
| 4,552,236 | A | 11/1985 | Mikami | |
| 4,553,616 | A | 11/1985 | Haze | |
| 4,561,510 | A | 12/1985 | Sugioka et al. | |
| 4,570,419 | A | 2/1986 | Tinsley | |
| 4,576,209 | A | 3/1986 | Eisenberg | |
| 4,595,125 | A | 6/1986 | Alwerud | |
| 4,657,054 | A * | 4/1987 | Schaltegger | 141/1 |
| 4,687,672 | A | 8/1987 | Vitkovsky | |
| 4,708,215 | A | 11/1987 | Nakamura et al. | |
| 4,719,739 | A * | 1/1988 | Foldesi | 53/306 |
| 4,721,173 | A | 1/1988 | Hirota et al. | |
| 4,723,614 | A | 2/1988 | Lahti | |
| 4,733,520 | A | 3/1988 | Rabbi | |
| 4,753,275 | A * | 6/1988 | Schaltegger | 141/1 |
| 4,784,275 | A | 11/1988 | Fridge | |
| 4,844,190 | A | 7/1989 | Mikami et al. | |
| 4,931,122 | A * | 6/1990 | Mitchell | 156/215 |
| 4,999,977 | A | 3/1991 | Briscoe et al. | |
| 5,081,822 | A | 1/1992 | Boyd et al. | |
| 5,104,002 | A | 4/1992 | Cahlander et al. | |
| 5,108,012 | A | 4/1992 | Rosso | |
| 5,195,294 | A | 3/1993 | Baranowski | |
| 5,195,298 | A | 3/1993 | Baranowski | |
| 5,246,118 | A | 9/1993 | Mosher | |
| 5,313,508 | A | 5/1994 | Ditman et al. | |
| 5,355,991 | A | 10/1994 | Baranowski | |
| 5,407,057 | A | 4/1995 | Baranowski | |
| 5,415,321 | A | 5/1995 | Gehlert et al. | |
| 5,454,016 | A | 9/1995 | Holmes | |
| 5,454,465 | A | 10/1995 | Baranowski | |
| 5,456,931 | A | 10/1995 | Egger et al. | |
| 5,458,055 | A | 10/1995 | Fitch, Jr. | |
| 5,522,512 | A | 6/1996 | Archer et al. | |
| 5,613,590 | A | 3/1997 | Simionato | |
| 5,638,417 | A | 6/1997 | Boyer et al. | |
| 5,638,657 | A | 6/1997 | Archer et al. | |
| 5,692,594 | A | 12/1997 | Sidler | |
| 5,726,394 | A | 3/1998 | Krämer sen. et al. | |
| 5,756,939 | A | 5/1998 | Taniguchi | |
| 5,762,113 | A | 6/1998 | Ricossa et al. | |
| 5,765,655 | A | 6/1998 | Tatsuoka | |
| 5,767,455 | A | 6/1998 | Mosher | |
| 5,804,772 | A | 9/1998 | Wooldridge et al. | |
| 5,829,493 | A | 11/1998 | Baranowski | |
| 5,878,865 | A | 3/1999 | Bailey et al. | |
| 5,938,074 | A | 8/1999 | Dartus | |
| 5,942,732 | A | 8/1999 | Holmes | |
| 6,098,785 | A | 8/2000 | Van Maanen | |
| 6,268,571 | B1 | 7/2001 | Benyukhis | |
| 6,273,238 | B1 | 8/2001 | Wooldridge | |
| 6,318,594 | B1 | 11/2001 | Hutchins | |
| 6,338,371 | B1 | 1/2002 | Araki et al. | |
| 6,351,676 | B1 | 2/2002 | Thomas | |
| 6,360,870 | B1 | 3/2002 | Wooldridge | |
| 6,421,982 | B1 | 7/2002 | Eichenberger | |
| 6,431,407 | B1 | 8/2002 | Hogan et al. | |
| 6,772,806 | B2 * | 8/2004 | De Villele | 141/144 |
| 2002/0134050 | A1 | 9/2002 | Thieman | 53/412 |
| 2002/0139589 | A1 | 10/2002 | Matsuyama et al. | |
| 2004/0007444 | A1 | 1/2004 | Baranowski | 198/757 |
| 2004/0007584 | A1 | 1/2004 | Baranowski | 221/200 |
| 2004/0053003 | A1 | 3/2004 | Ferrero et al. | |

FOREIGN PATENT DOCUMENTS

| | | |
|---|---|---|
| EP | 0195428 | 9/1986 |
| EP | 0678738 | 10/1995 |
| WO | 9919215 | 4/1999 |
| WO | 0020306 | 4/2000 |
| WO | 0138202 | 5/2001 |
| WO | 02077582 | 10/2002 |

OTHER PUBLICATIONS

Barry Graham and Paula Madden, Precision Feeding For Coating and Plating Processes, Fastener Technology International (Jun. 2000).

Donald Wooldridge, New Packaging Line For Fastener Kits, Fastener Technology International (Dec. 1997).

Gina Donliu, RTA Hardware Gains Precision Packaging, Furniture Design and Manufacturing (Dec. 1994).

Batching Systems Inc., Labor Savings Drive Auto Parts vf/f/s Bagging, Packaging Digest (Oct. 1996).

Batching Systems Inc., Batching Systems Kit Packaging Systems, Brochure (Feb. 1998).

Batching Systems Inc., Bagmaster ®T Series Baggers, Brochure (May 2000).

Batching Systems Inc., Aucillary Equipment, Brochure (Feb. 1998).

Batching Systems Inc., Batchmaster ®FAW (Fast Automatic Weigher), Brochure (Dec. 1999).

FMC Technologies, Syntron® Material Handling Solutions, Rotary Bowl Feeders, (at least as early as Apr. 2002).

FMC Technologies, Syntron® Material Handling Solutions, Electromagnetic Vibrating Feeders (Light Duty) (at least as early as Jan. 2004).

NTI Ltd., LinMot® Linear Servo Motors, (Jun. 2001).

Quicksilver Controls, Inc., SilverMax™ Fully Integrated Servomoters, Dec. 2001.

Batching Systems Inc., Batch 'n Clamshell Packaging Systems, Brochure (Jul. 2000).

Batching Systems, Inc., Bagmaster® C Series Baggers—Centerfold Web Style Machine, Brochure (Feb. 1998).

Batching Systems, Inc., Bagmaster® F Series Bagger—Flat Web Style Machine, Brochure (Feb. 1998).

Batching Systems, Inc., Batchmaster® Ultra, Brochure (Feb. 1998).

Batching Systems, Inc., Batchmaster® Counters, Brochure (Dec. 1999).

* cited by examiner

DISPENSING SYSTEMS AND METHODS

This application claims priority from U.S. Provisional Patent Application No. 60/390,364 entitled "Rotary, Vibratory, Dispensing Systems and Methods," and filed on Jun. 24, 2002, and U.S. Provisional Patent Application No. 60/454,605 entitled "Dispensing Systems and Methods," and filed on Mar. 17, 2003, the disclosures of which are incorporated herein by reference in their entirety.

BACKGROUND OF THE INVENTION

1. Field of the Invention

The present invention relates generally to dispensing systems and methods of dispensing items. More particularly, the present invention relates to vibratory dispensing systems and to methods of dispensing items in such systems.

2. Description of Related Art

Known dispensing systems and methods of dispensing items may convey a plurality of containers to a dispensing station, at which a dispenser may dispense items to each container. Moreover, each of the dispensed items may be counted, and predetermined quantities of items may be directed to each container.

In known control systems, however, the accuracy of the count of dispensed items may be affected by operation of known dispensers. For example, the ability of known control systems to operate dispensers to dispense items singularly, e.g., in a single file, may improve the accuracy of the count of dispensed items. If two or more items are dispensed simultaneously, known control systems may count the items as a single item, thereby undermining the accuracy of the count of dispensed items. Thus, known dispensing control systems may reduce or limit the rate at which items are dispensed in order to improve the accuracy of a count of dispensed items. Moreover, known dispensing systems may dispense items to containers while containers are stationary. Each of these systems reduces a rate at which containers may be filled in known dispensing systems.

SUMMARY OF THE INVENTION

A need has arisen for dispensing systems and methods of dispensing items that increase a rate at which items may be dispensed to containers that are conveyed to and through a dispensing station. More particularly, a need has arisen for dispensing systems and methods of dispensing items that convey a plurality of containers to and through a dispensing station, so that a dispenser may direct predetermined quantity of items to each container.

According to an embodiment of the present invention, a system for dispensing items includes a first dispensing station and a first conveyor for transporting containers to the first dispensing station. The first dispensing station includes a dispenser for directing items to the containers, a mechanism for spacing the containers to a predetermined pitch, a transfer wheel for removing the containers from the first conveyor, a star wheel for receiving the containers from the transfer wheel and for transporting the containers in synchronization with the dispenser, and a turret for removing the containers from the star wheel.

In another embodiment of the present invention, a method of dispensing items comprises the steps of conveying a plurality of containers to a dispensing station, spacing the containers to a predetermined pitch, transferring the containers to the dispensing station, transporting the containers through the dispensing station, and removing the containers from the dispensing station.

Other objects, features, and advantages of embodiments of the present invention will be apparent to persons of ordinary skill in the art from the following description of preferred embodiments with reference to the accompanying drawings.

BRIEF DESCRIPTION OF THE DRAWINGS

The invention may be understood more readily by reference to the following drawings.

DETAILED DESCRIPTION OF PREFERRED EMBODIMENTS

Figure 1:
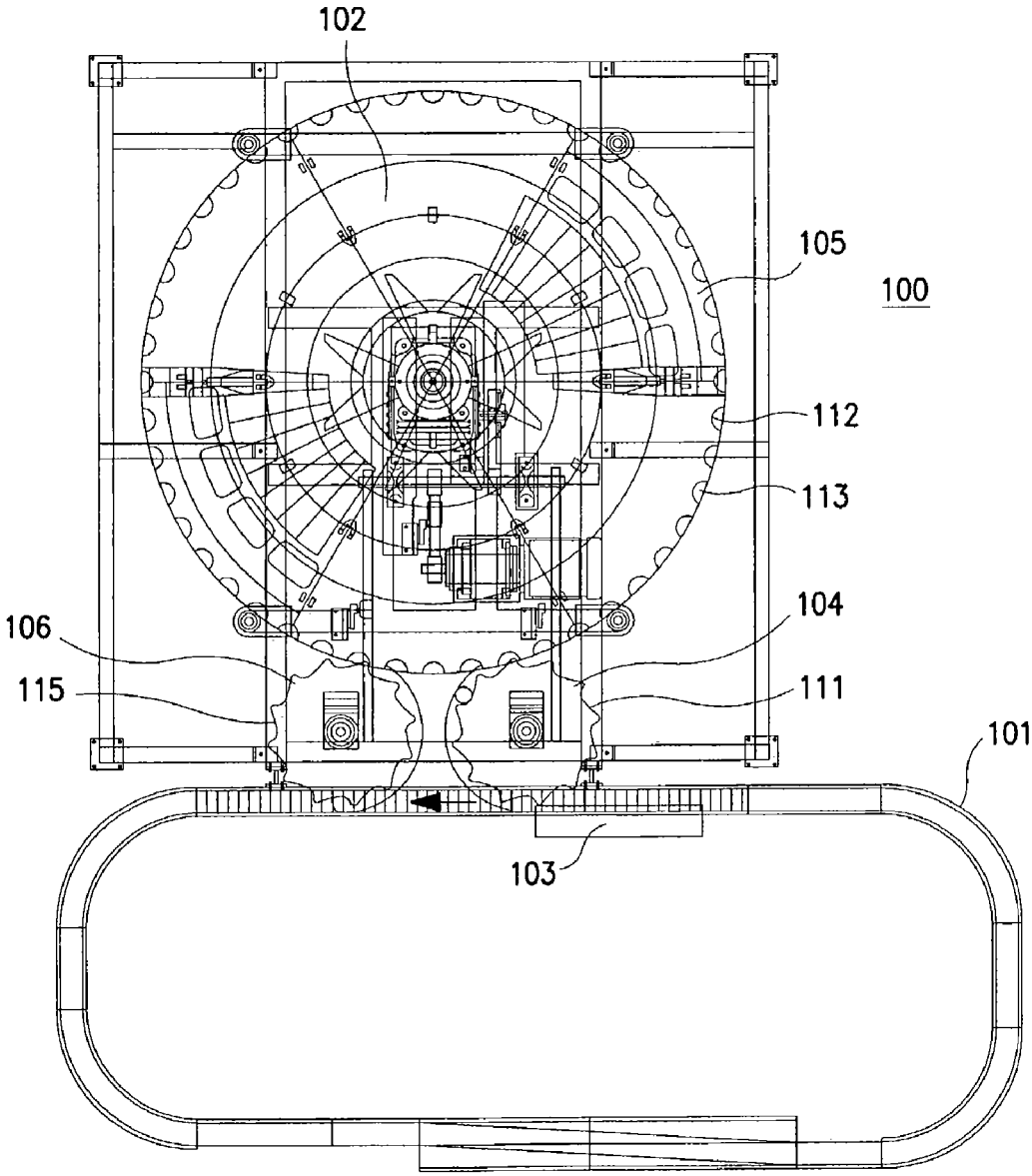
FIG. 1 shows a partially cutaway plan view of a dispensing system according to an embodiment of the present invention.
Figure 2:
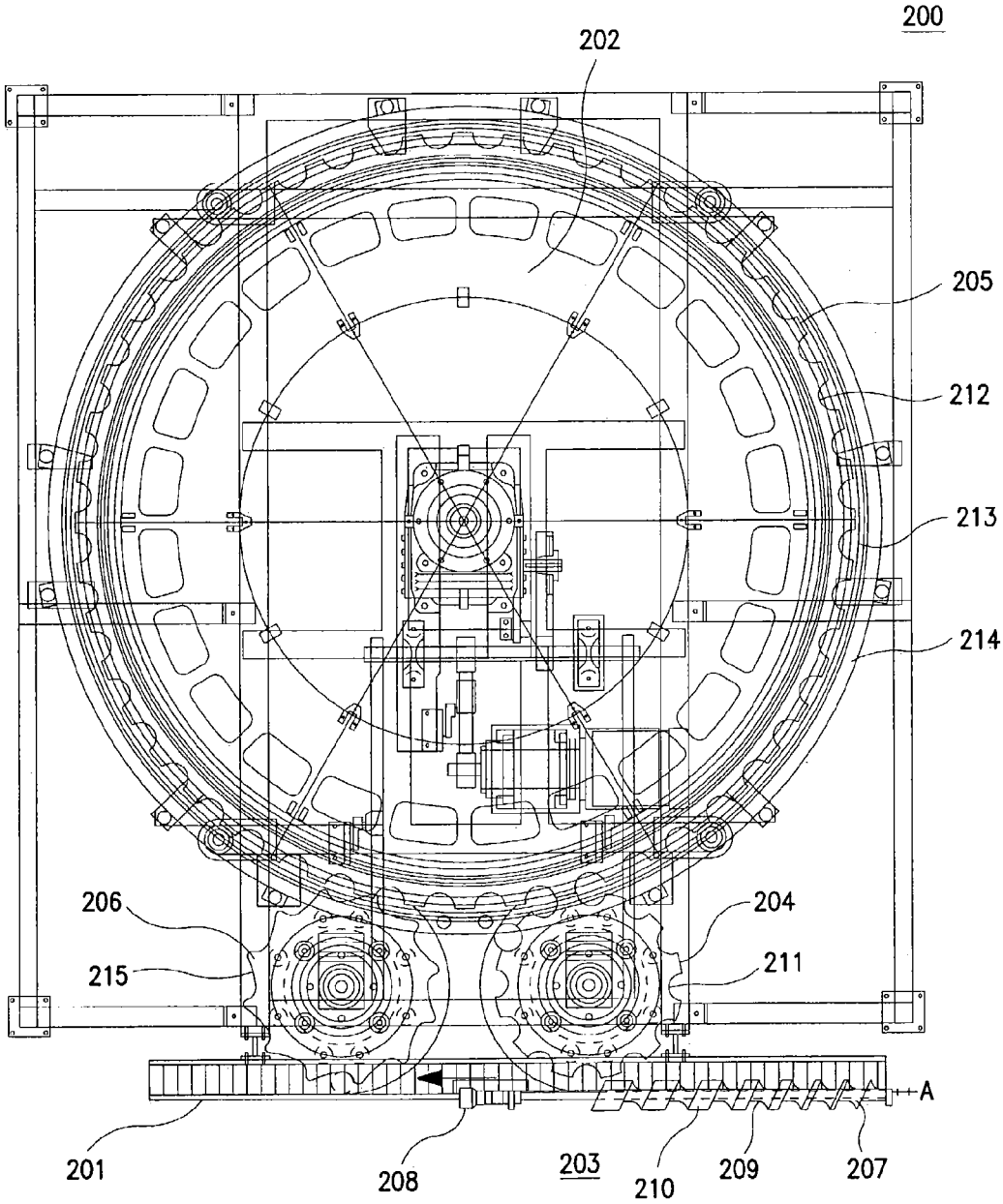
FIG. 2 shows a partially cutaway plan view of a dispensing system according to another embodiment of the present invention.

FIGS. 1 and 2 show a dispensing system 100, 200, according to an embodiment of the present invention. Each dispensing system 100, 200 may comprise a dispensing station 102, 202 and a conveyor 101, 201 for transporting containers, e.g., packages, boxes, bottles, jars, cans, bowls, plates, pans, and the like (not shown), to and from the dispensing station 102, 202. Each dispensing station 102, 202 may comprise a dispenser for directing a predetermined quantity of items to each container, a spacing mechanism 103, 203 for spacing each of the containers to a predetermined pitch on the conveyor 101, 201, a transfer wheel 104, 204 for removing the spaced containers from the conveyor 101, 201, a star wheel 105, 205 for receiving the containers from the transfer wheel 104, 204 and for transporting the containers in synchronization with a dispenser, e.g., in alignment with, at a substantially similar rotational speed as, or the like, and a turret 106, 206 for receiving the containers from the star wheel 105, 205 and moving the containers to conveyor 101, 201.

As shown in FIGS. 1 and 2, each conveyor 101, 201 may transport containers to dispensing station 102, 202. Each conveyor 101, 201 may transport containers away from dispensing station 102, 202. As shown in FIGS. 1 and 2, a single conveyor 101, 201 may transport containers to and from dispensing station 102, 202. In another embodiment of the invention (not shown), a first conveyor may transport containers to a dispensing station, and a second conveyor may transport containers away from dispensing station. First and second conveyor comprise separate drive units, so that containers may be transported to and from dispensing station at different rates, as necessary. For example, a first conveyor may transport containers to a dispensing station at a different rate than a second conveyor transports containers away from the dispensing station, so that containers may be transported from the dispensing station to a packaging station or to another dispensing station, each of which may operate at different rates.

As shown in FIG. 1, conveyor 101 may be configured to transport a plurality of containers along a substantially closed-loop track. One or more dispensing stations 102 may be positioned adjacent to conveyor 101, each of which dispensing stations 102 may direct items to containers transported by conveyor 101. Moreover, a packaging station (not shown) may be positioned adjacent to conveyor 1101. Further, conveyor 101 may be dimensioned, so that one or more dispensing stations 102 may be positioned adjacent to conveyor 101 on different sides of conveyor 101.

As shown in FIG. 2, conveyor 201 may be configured to transport a plurality of containers along a substantially linear track, a portion of which is shown in FIG. 2. One or more dispensing stations 202 may be positioned adjacent to conveyor 201, each of which dispensing stations 202 may direct items to containers transported by conveyor 101. Moreover, a packaging station (not shown) may be positioned adjacent to conveyor 201. Further, conveyor 201 may be dimensioned, so that one or more dispensing stations 202 may be positioned adjacent to conveyor 201 on different sides of conveyor 201.

A spacing mechanism 103, 203, e.g., a timing screw 207, an index finger, a foil, or the like, may be positioned adjacent to a portion of conveyor 101, 201. Spacing mechanism 103, 203 operates to engage each of a plurality of containers transported to dispensing station 102, 202 by conveyor 101, 201 and to space each container to a predetermined pitch, e.g. to a predetermined distance or spacing between adjacent containers. The predetermined pitch may correspond to a pitch of transfer wheel 104, 204, star wheel 105, 205, and turret 106, 206, so that containers may be transported through dispensing station at a substantially constant pitch.

In an embodiment of the invention, a timing screw 207 may be positioned adjacent to conveyor 201. Timing screw 207 may engage containers transported by conveyor 201 to dispensing station 202 and space each container to a predetermined pitch, such that containers may be transported through dispensing station 202 to receive dispensed items. Timing screw 207 operates to engage containers transported by conveyor 101, 201 and to adjust the spacing between containers to correspond to a spacing required of containers at dispensing station 102, 202, e.g., to a spacing between adjacent container-receiving grooves of star wheel 105, 205. Timing screw 207 may be positioned so that a longitudinal axis A of timing screw 207 is substantially parallel to a portion of conveyor 201 adjacent to dispensing station 202, as shown in FIG. 2. A timing screw drive 208 may rotate timing screw 207 about its longitudinal axis at variable rotational speeds. Timing screw 207 further includes an alternating series of container-engaging grooves 209 and helical ribs 210.

According to one embodiment of the invention shown in FIG. 2, a width of each rib 210 may increase as each successive rib is positioned nearer to transfer wheel 204. Each container-engaging groove 209 may engage a container transported on conveyor 201 to dispensing station 202. Rotation of timing screw 207 enables timing screw 207 to engage and progressively space each container to a predetermined pitch as containers approach dispensing station 202 on conveyor 201. The predetermined pitch of the dispensing station 202 may be greater than a pitch of containers being conveyed to dispensing station 202, so that spacing mechanism 103, 203 may increase a distance or spacing between adjacent containers when spacing mechanism 103 engages the containers and spaces them to a predetermined pitch of dispensing station 202.

According to another embodiment of the present invention (not shown), a width of each rib may decrease as each successive rib is positioned nearer to transfer wheel 204, so that rotation of timing screw 207 may enable timing screw 207 to engage and progressively space each container to a predetermined pitch that may be less than a pitch of containers conveyed to dispensing station 202, so that spacing mechanism 103 may decrease a distance or spacing between adjacent containers when spacing mechanism 103 engages the containers and spaces them to a predetermined pitch of dispensing station 202.

A guard rail (not shown) may be positioned adjacent to at least a portion of timing screw 207 to maintain containers in engagement with container-receiving grooves 209 of timing screw 207. Moreover, a plow (not shown), or the like, may be positioned adjacent to conveyor 101, 201 to engage containers, as necessary, and move containers to a portion of conveyor 101, 201, so that spacing mechanism 103, 203, may engage the containers and space the containers to a predetermined pitch.

A transfer wheel 104, 204 may be positioned adjacent to spacing mechanism 103, 203. For example, transfer wheel 104, 204 may be positioned between spacing mechanism 103, 203 and dispensing station 102, 202. Transfer wheel 104, 204 may remove containers from conveyor 101, 201 and move containers to star wheel 105, 205, while maintaining a predetermined pitch of containers.

Transfer wheel 104, 204 may include a plurality of container-receiving grooves 111, 211, each of which grooves may be positioned along a periphery of transfer wheel 104, 204. As shown in FIG. 1, container-receiving grooves 111 may comprise a substantially elliptical curve. As shown in FIG. 2, container-receiving grooves 211 may comprise a substantially semicircular curve. Moreover, container-receiving grooves 211 of different shape and dimension may be mounted interchangeably to transfer wheel 204, so that transfer wheel 204 may receive and position containers of varying dimension and shape at different pitches. In another embodiment of the invention, transfer wheels 104 comprising container-receiving grooves 111 of different shape and dimension may be mounted interchangeably at dispensing station 102, so that transfer wheel 104 may receive and position containers of varying dimension and shape at different pitches.

A spacing between adjacent container-receiving grooves 111, 211 of transfer wheel 104, 204 may correspond to a pitch of timing screw 207 or spacing mechanism 103, 203, so that transfer wheel 104, 204, may engage each container after each container has been engaged by timing screw 207 or spacing mechanism 103, 203, and remove each container from conveyor 101, 201. The spacing between adjacent container-receiving grooves 111, 211 of transfer wheel 104, 204 also may correspond to a pitch of containers to be transported by star wheel 105, 205, so that transfer wheel 104, 204, may remove containers from conveyor 101, 201 and move each container to star wheel 105, 205, such that each container is aligned with a respective container-receiving groove 112, 212, of star wheel 105, 205. By maintaining the container pitch of timing screw 207 or spacing mechanism 103, 203, transfer wheel 104, 204 may place each container in alignment with a respective container-receiving groove 112, 212, of star wheel 105, 205, so that containers may be transported to and through dispensing station 102, 202, at increased rates over known dispensing systems.

A star wheel 105, 205, may receive containers from transfer wheel 104, 204, and transport containers in synchronization, e.g., in alignment with, at a substantially similar rotational speed as, or the like, with a dispenser (not shown) positioned at dispensing station 102, 202. For example, star wheel 105, 205 may transport containers at a rotational speed that is substantially similar to a rotational speed of a dispenser and dispensing heads, so that star wheel 105, 205 may position each container in alignment with a respective dispensing path of dispensing head of dispenser (not shown) to receive items dispensed therefrom.

Star wheel 105, 205, may include a plurality of container-receiving grooves 112, 212, positioned along a periphery, e.g., an outer edge of, star wheel 105, 205. According to one embodiment of the invention, star wheel 105, 205 may include one hundred (100) container-receiving grooves 112, 212. In another embodiment of the invention, star wheel 105, 205 may include twelve (12) container-receiving grooves 112, 212. However, star wheel 105, 205 may include any number of container-receiving grooves 112, 212, each of which container-receiving groove 112, 212, may receive a container, so that star wheel 105, 205 may convey a plurality of containers.

Container-receiving grooves 112, 212, may be generally semi-circular, as shown in FIGS. 1 and 2. However, container-receiving grooves 212 of different shape and dimension (not shown) may be mounted interchangeably to star wheel 205, so that star wheel 205, may receive and position containers of varying dimension and shape at different pitches. In another embodiment of the invention, star wheels 112 comprising container-receiving grooves of varying dimension and shape may be mounted at dispensing station 102, so that each respective star wheel 105 may receive and position containers of varying dimension and shape at different pitches. Container-receiving grooves 112, 212 may maintain containers at a predetermined pitch, so that containers may receive items from a dispenser, e.g., from dispensing paths of a dispenser, from dispensing heads of a dispenser, or the like. More particularly, each container-receiving groove 112, 212, may position a container in alignment with a respective dispensing path, or dispensing head, or both, to receive items dispensed therefrom.

The spacing between adjacent container-receiving grooves 112, 212 of star wheel 105, 205 may correspond to a spacing between container-engaging grooves 111, 211 of transfer wheel 104, 204 and to a pitch of spacing mechanism 103, 203, so that containers may be spaced to a substantially similar predetermined pitch by spacing mechanism 103, 203, e.g., by a timing screw 107, and maintained at the predetermined pitch by transfer wheel 104, 204 and star wheel 105, 205.

Star wheel 105, 205 may be positioned above at least one base segment 113, 213. Base segment 113, 213 may support containers as star wheel 105, 205 transports containers through dispensing station 102, 202. Moreover, a guard rail 214 may be positioned adjacent to star wheel 105, 205, e.g., adjacent to container-engaging grooves 112, 212 of star wheel 105, 205, to maintain containers in engagement with respective container-receiving grooves 112, 212 of star wheel 105, 205. As shown in FIG. 2, guard rail 214 may have a generally arcuate shape and extend along a periphery of star wheel between transfer wheel 204 and turret 206.

Turret 106 206 may receive containers from star wheel 106, 205 and move containers to conveyor 101, 201. Turret 106, 206 may be positioned between star wheel 105, 205 and conveyor 101, 201. For example, turret 106, 206 may be positioned adjacent a portion of conveyor 101, 201 that is downstream from transfer wheel 104, 204.

Turret 106, 206 may include a plurality of container-receiving grooves 115, 215, each of which container-receiving grooves 115, 215 may receive a container from star wheel 105, 205 and move the container to conveyor 101, 201. Moreover, container-receiving grooves 215 of different shape and dimension may be mounted interchangeably to turret 206, so that turret 206 may receive and position containers of varying dimension and shape at different pitches. In another embodiment of the invention turrets 106 comprising container-receiving grooves 115 of different shape and dimension may be mounted interchangeably at dispensing station 102, so that each respective turret 105 may receive and position containers of varying dimension and shape at different pitches. A spacing between adjacent container-receiving grooves 115, 215 of turret 106, 206 may correspond to a pitch of containers transported by star wheel 105, 205. In another embodiment of the invention, turret 106, 206 may space containers to a pitch that is greater than or less than a pitch of containers transported by star wheel 105, 205.

Conveyor 101, 201, spacing mechanism 103, 203, transfer wheel 104, 204, star wheel 105, 205, dispenser (not shown), and turret 106, 206 may be powered by one or more drives (not shown). In one embodiment of the invention, a single drive unit (not shown) may drive conveyor 101, 202, spacing mechanism 103, 203, transfer wheel 104, 204, star wheel 105, 205, dispenser (not shown), and turret 106, 206, via a transmission, e.g., via drive belts, pulleys, gears, or the like. In another embodiment of the invention, separate drives may power each of conveyor 101, 201, spacing mechanism 103, 203, transfer wheel 104, 204, star wheel 105, 205, dispenser (not shown), and turret (106, 206). For example, a star wheel drive (not shown) may rotate star wheel 105, 205 at a variety of rotational speeds. A control unit (not shown) may control each drive or drives, thereby controlling operation of conveyor 101, 201, spacing mechanism 103, 203, transfer wheel 104, 204, star wheel 105, 205, dispenser (not shown), and turret 106, 206, so that containers may move continuously to, through, and away from the dispensing station 102, 202.

Figure 3:
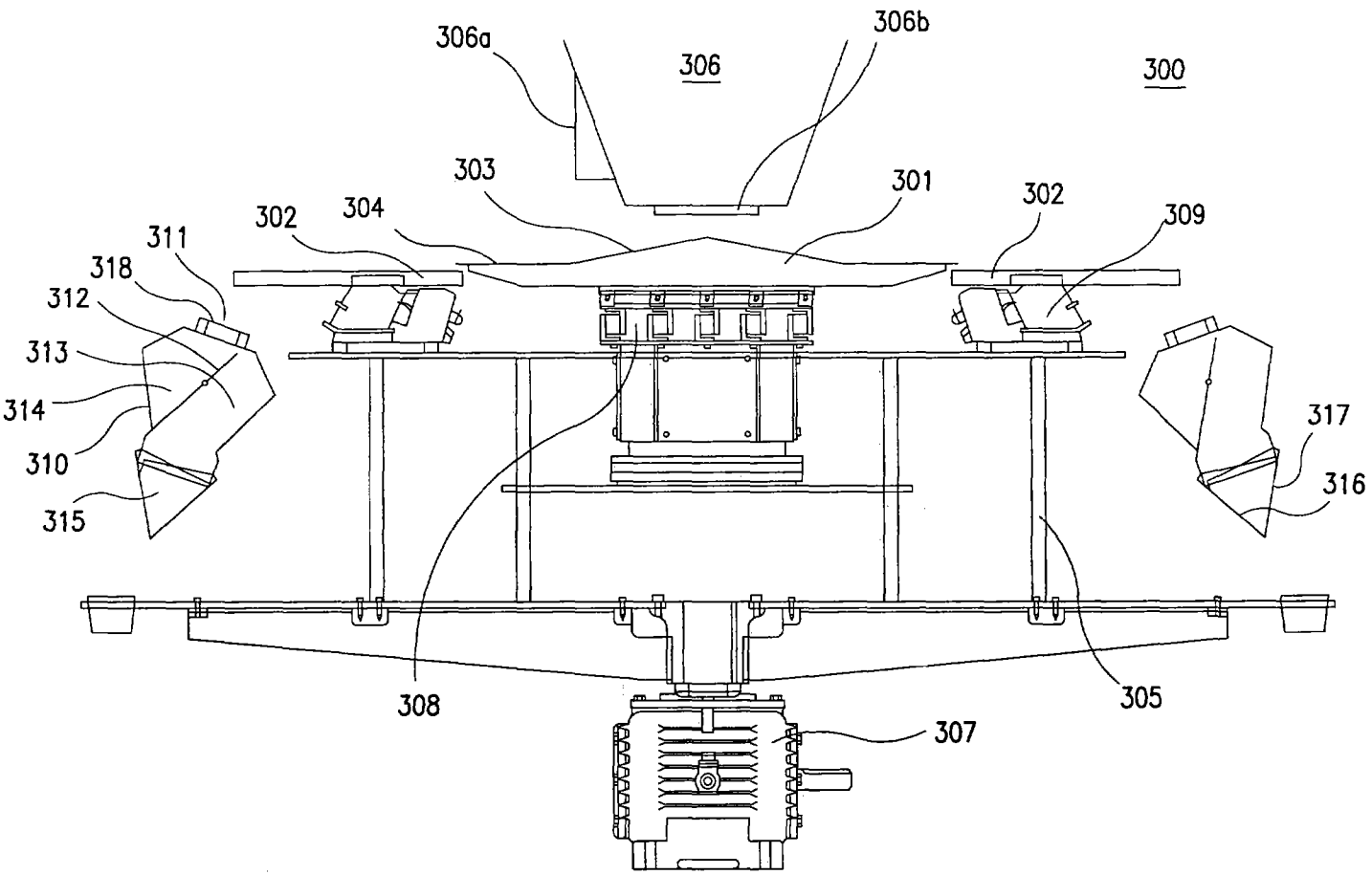
FIG. 3 shows a side view of a dispenser of the present invention.
Figure 4:
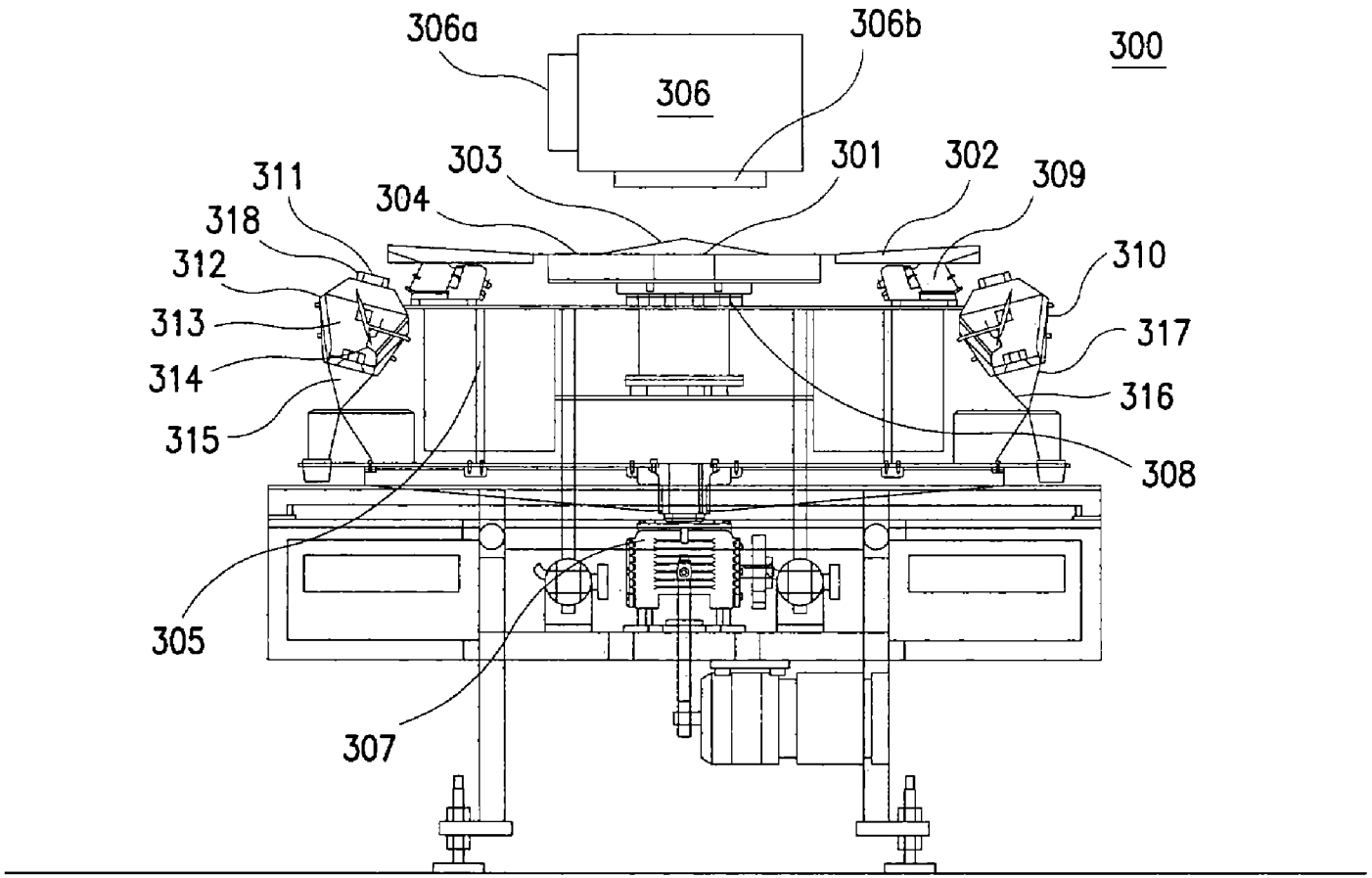
FIG. 4 shows a side view of a dispenser of the present invention.

Dispensing station 102, 202 may include a dispenser to dispense items to containers transported through dispensing station 102, 202. According to an embodiment of the invention, dispensing station 102, 202 may include a rotary, vibratory dispenser. As shown in FIGS. 3 and 4, a rotary, vibratory dispenser 300 may include a feeder bowl 301 for receiving a plurality of items to be dispensed from rotary, vibratory dispenser 300, a plurality of dispensing paths 302 positioned around the feeder bowl 301 for receiving items supplied by the feeder bowl 301, a feeder bowl rotation drive 307 for rotating feeder bowl 301, a feeder bowl vibration device 308 for vibrating feeder bowl 301, and one or more dispensing path vibration devices 309 for vibrating each dispensing path 302, so that each dispensing path 302 may dispense items singularly, sensing units 318. 418 for measuring a physical characteristic, e.g., a volume, a weight, a density, or the like, of each singularly-dispensed item, and dispensing heads 310 for receiving singularly-dispensed items from each dispensing path 302, so that predetermined quantities of items maybe directed to a container. A bulk delivery apparatus 306, e.g., a hopper, a conveyor, or the like, may deliver items to rotary, vibratory dispenser 300, e.g., to feeder bowl 301 of rotary, vibratory dispenser 300.

Rotary, vibratory dispenser 300 may be used to receive and dispense a variety of food items, e.g., dried food items, frozen food items, thawed food items, or the like. For example, rotary, vibratory dispenser 300 may dispense dried food items, such as dried pasta, dehydrated vegetables, or the like. Moreover, rotary, vibratory dispenser 100 may be used to dispense frozen food items, e.g., frozen meats, frozen vegetables, or the like. Rotary, vibratory dispenser 300 may be used to dispense items of varying physical characteristic, e.g., varying weight, volume, density, temperature, or the like, including non-food items of varying physical characteristic. For example, the rotary, vibratory dispenser 300 may dispense fasteners, hardware, medical items, electronic parts, mechanical parts, metallic and non-metallic items, or the like.

Figure 10A:
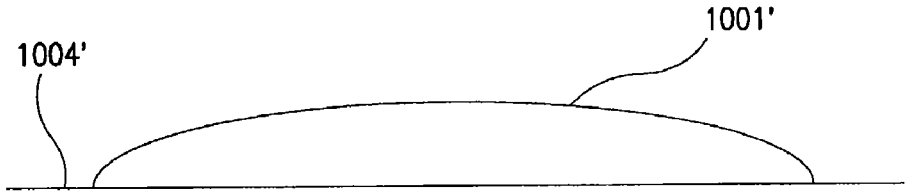
FIG. 10*a* shows a cross-sectional view of a dome-shaped feeder bowl according to an embodiment of the present invention
Figure 10B:
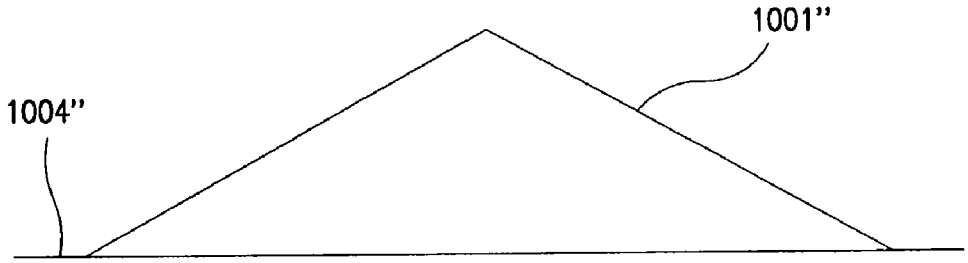
FIG. 10*b* shows a cross-sectional view of a conical-shaped feeder bowl according to an embodiment of the present invention.

Feeder bowl 301 may include a variety of shapes and configurations. The configuration of feeder bowl 301 may vary, depending upon the intended application and physical characteristic, e.g., a weight, a volume, a density, or the like, of items to be dispensed. FIGS. 3 and 4 show an embodiment of a feeder bowl 301 with an attenuated conical shape and a substantially planar peripheral edge 304. Feeder bowl 301 may be substantially dome-shaped, substantially conical-shaped, substantially-planar; or the like. Moreover, each of these embodiments of feeder bowl 301 may include a substantially planar peripheral edge. FIG. 10*a* shows a cross-section of a dome-shaped feeder bowl 1001' with a substantially planar peripheral edge 1004'. FIG. 10*b* shows a cross-section of a conical-shaped feeder bowl 1001" with a substantially planar peripheral edge 1004".

Figure 10C:
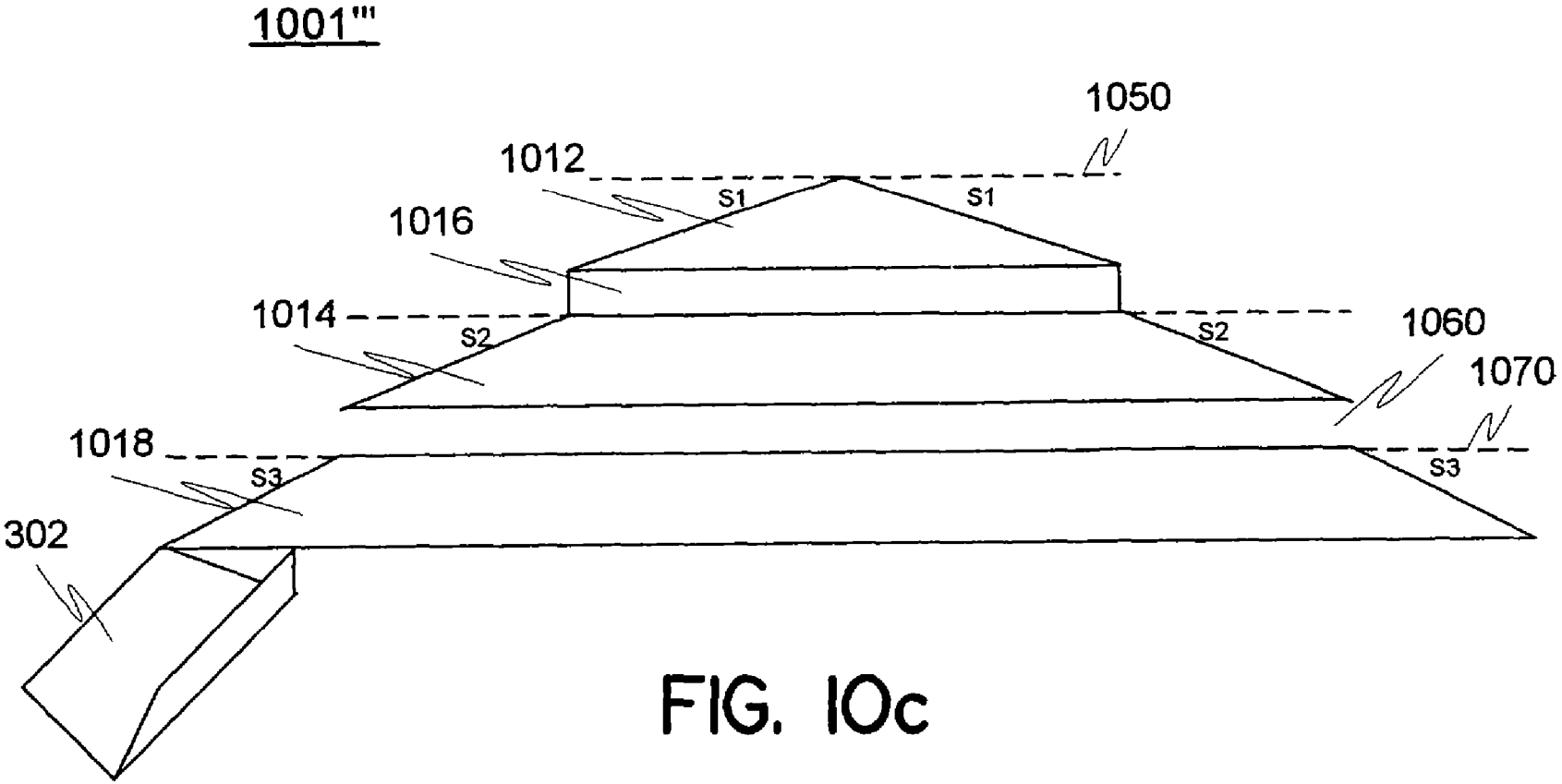
FIG. 10*c* shows a cross-sectional view of a sloped feeder bowl according to an embodiment of the present invention.

FIG. 10*c* shows a feeder bowl 101'" according to yet another embodiment of the present invention. Feeder bowl 101'" may comprise a plurality of sloped portions, and each of the sloped portions may be separated by a substantially cylindrical portion. For example, feeder bowl 101'" may comprise a first sloped portion 1012 and a second sloped portion 1014 connected to first sloped portion 1012 via a substantially cylindrical portion 1016. Cylindrical portion 1016 may form a vertical drop between first sloped portion 1012 and second sloped portion 1014. In an embodiment, a thickness of cylindrical portion 1016 may be selected, such that a distance between first sloped portion 1012 and second sloped portion 1014 is about 25.4 mm (about 1 inch). Moreover, first sloped portion 1012, second sloped portion 1014, and substantially cylindrical portion 1016 may be stationary portions, i.e., non-rotating portions, or vibratory portions, or both. First sloped portion 1012 and second sloped portion 1014 may gradually accelerate the fall of items dispensed by bulk delivery apparatus 106 to feeder bowl 101'". Specifically, a slope S1 of second sloped portion 1014 may be greater than a slope S2 of first sloped portion 1012, such that an item's speed increases between first sloped portion 1012 and second sloped portion 1014. In a preferred embodiment, first sloped portion 1012 may be inclined in a downward direction relative to a first horizontal plane 1050, and slope S1 of first sloped portion 1012 may be about 9.5° relative to first horizontal plane 1050. Moreover, second sloped portion 1014 may be inclined in a downward direction relative to a second horizontal plane 1060 which is parallel to first horizontal plane 1050, and slope S2 of second sloped portion 1014 may be about 12° relative to second horizontal plane 1060. This preferred embodiment achieved superior performance with most items tested. Nevertheless, in yet another embodiment, slope S1 of first sloped portion 1012 and slope S2 of second sloped portion 1014 may be varied, depending on the type of item dispensed from bulk delivery apparatus 106.

Feeder bowl 101'" also may comprise a sloped member 1018 fixed to a plurality of dispensing paths 302, such that sloped member 1018 may rotate with dispensing paths 302. Sloped member 1018 may be separate from second sloped portion 1014, such that a gap 1020 is formed between second sloped portion 1014 and sloped member 1018. In an embodiment, sloped member 1018 may be inclined in a downward direction relative to a third horizontal plane 1070 which is parallel to second horizontal plane 1060. In operation, items fall from second sloped portion 1014 onto the surface of sloped member 1018 and, subsequently may become airborne. A slope S3 of sloped member 1018 relative to third horizontal plane 1070 may be selected to reduce the amplitude of the airborne items. For example, slope S3 of sloped portion 1018 may be between about 1° and about 15°, and in a preferred embodiment, slope S3 of sloped portion 1018 is about 15°. Moreover, dispensing paths 302 may be inclined in a downward direction, such that a slope of dispensing paths 302 is about the same as slope S3 of sloped member 1018. Although in FIG. 10*c* sloped member 1018 is depicted as a single portion member, sloped member may be divided into a plurality of sloped portions having varying slopes, such as described above with respect to first sloped portion 1012, second sloped portion 1014, and substantially cylindrical portion 1016.

Referring again to FIGS. 3 and 4, dispensing paths 302 may be positioned around feeder bowl 301 to receive items supplied by feeder bowl 301. Dispensing paths 302 may be positioned around a periphery of feeder bowl 301 and extend radially from feeder bowl 301 to receive items supplied by feeder bowl 301. The length of each dispensing path 302 may vary depending upon a variety of factors, such as the space available for the rotary, vibratory dispenser 300, a physical characteristic of items to be dispensed, a predetermined dispensing rate, a rotational speed of the dispensing paths 302, or the like. The number of dispensing paths 302 may vary. For example, forty-eight (48) dispensing paths 302 may be positioned around feeder bowl 301. According to one embodiment of the invention, one hundred (100) dispensing paths 302 may be positioned around feeder bowl 301. In another embodiment of the invention, twelve (12) dispensing paths 302 may be positioned around feeder bowl 301. However, any number of dispensing paths 302 may be positioned around feeder bowl 301.

Figure 5:
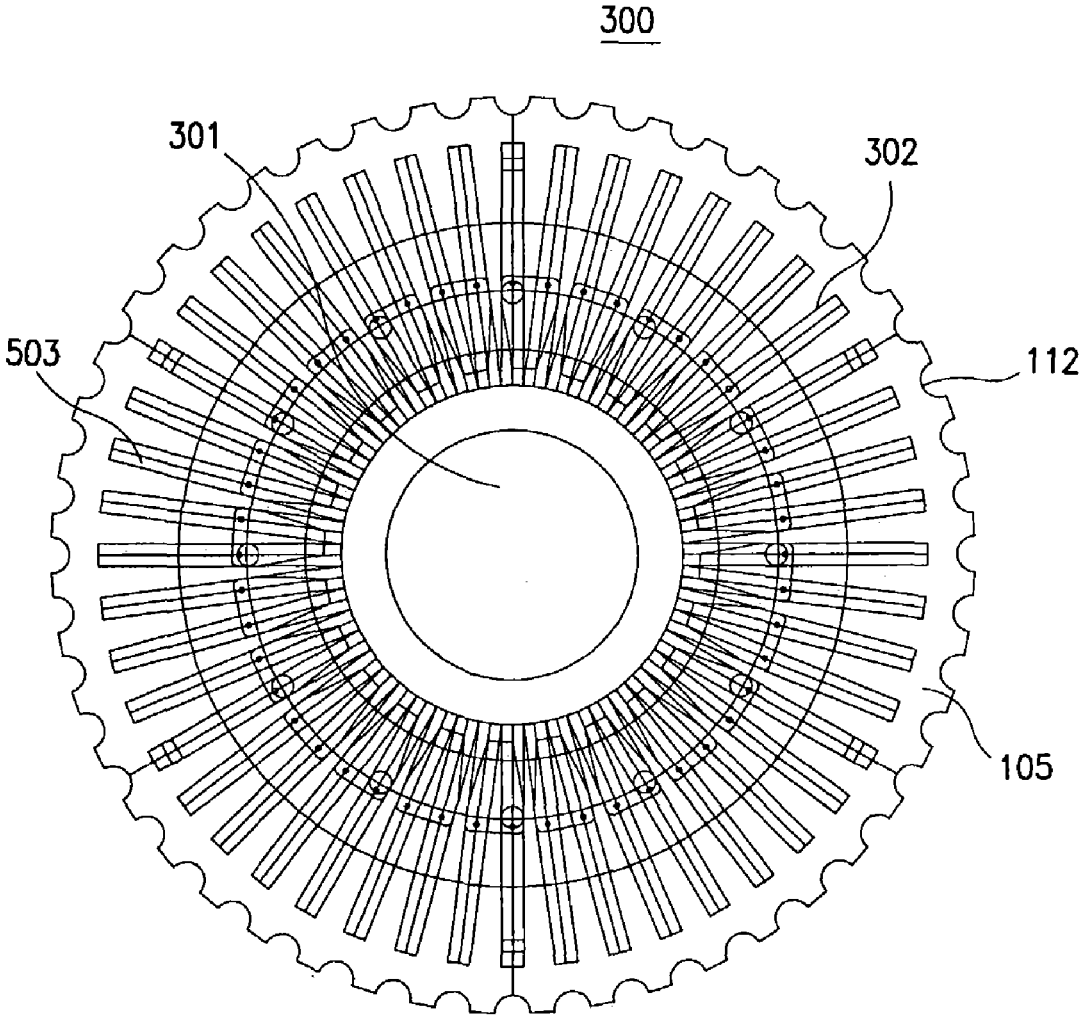
FIG. 5 shows a partially cutaway plan view of a dispenser of the present invention.
Figure 6:
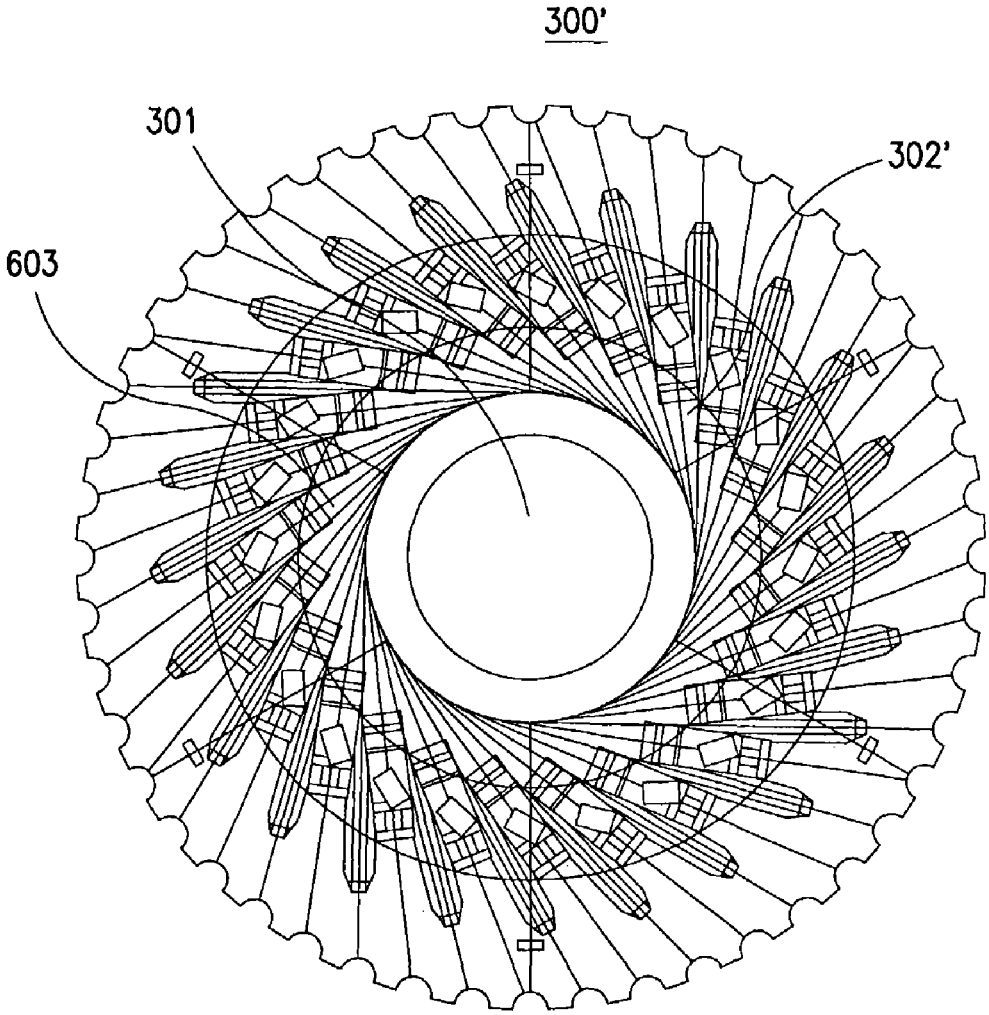
FIG. 6 shows a partially cutaway plan view of another embodiment of a dispenser of the present invention.

Moreover, dispensing paths 302 may be positioned around feeder bowl 301 in a variety of configurations. As shown in FIG. 5, rotary, vibratory dispenser 300 may include dispensing paths 302 that may be positioned around a periphery of feeder bowl 301 and extend radially from feeder bowl 301. As shown in FIG. 6, rotary, vibratory dispenser 300' may include dispensing paths 302' that may be positioned around a periphery of feeder bowl 301 and extend in an arc-shaped pattern from feeder bowl 301 that may be opposite to a direction of rotation of feeder bowl 301. As with other embodiments of the invention, the number of dispensing paths may vary. For example, forty-eight dispensing paths 302, 302' may be positioned around feeder bowl 301, as shown in FIGS. 5 and 6. In another embodiment, twelve (12) dispensing paths 302, 302' may be positioned around feeder bowl 301. However, any number of dispensing paths 302, 302' may be positioned around feeder bowl 301.

Each dispensing path 302 may comprise one or more item-dispensing channels, each of which channels may dispense items singularly. However, each dispensing path 302 may comprise two or more channels. As shown in FIG. 5, each dispensing path 302 may comprise a single channel 503. However, each dispensing 302 path may comprise two or more channels. FIG. 5 also shows an embodiment of a rotary, vibratory dispenser 300, in which container-receiving grooves 112 of star wheel 105 may align containers with each dispensing path 3.02.

As shown in FIG. 6, each arc-shaped dispensing path 302' may include a single channel 603. Thus, in an embodiment of the invention in, which rotary, vibratory dispenser 300, 300' is configured with forty-eight (48) dispensing paths 302 and each dispensing path 302 includes two channels, rotary, vibratory dispenser 300 may dispense items from each of the ninety-six (96) channels. The number of channels may vary depending upon the number of containers to be filled at a rotary, vibratory dispenser, the number of dispensing heads 310 and sensing units 318 or the like.

Each channel, e g., channel 503, may have a substantially constant width and extend radially from feeder bowl 300, as shown in FIG. 5. In another embodiment of the invention, a width of each channel, e.g., channel 603, may increase as each channel extends from feeder bowl, as shown in FIG. 6.

Figure 11A:
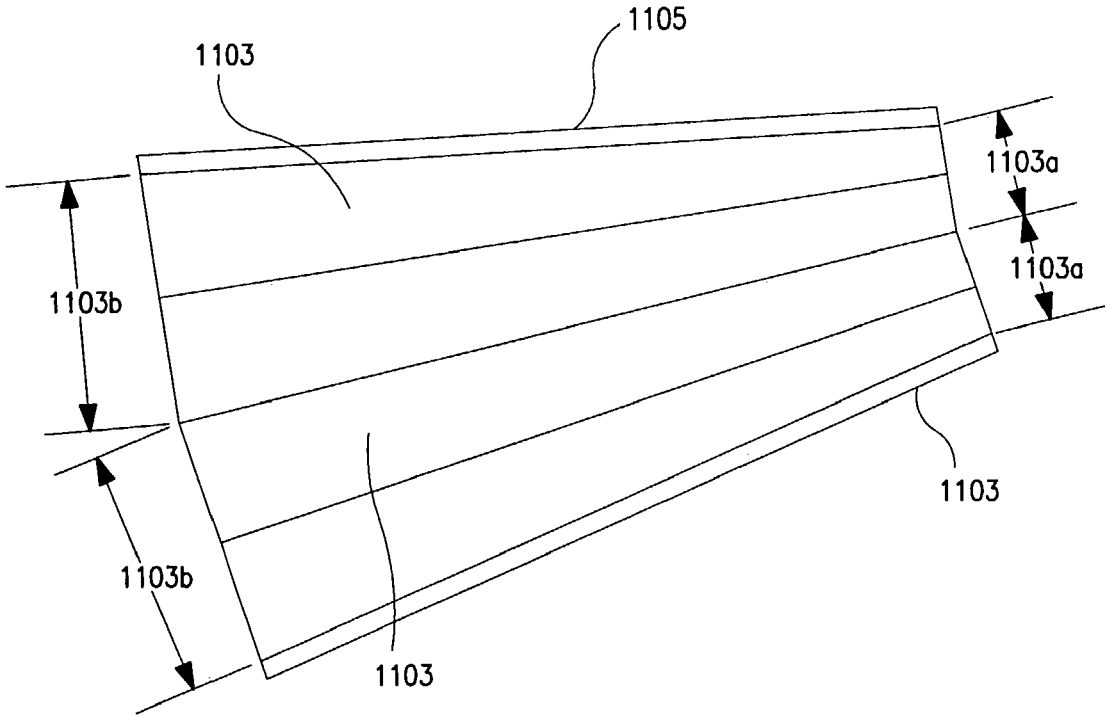
FIG. 11*a* shows a top view of a channel according to the present invention.

FIG. 11*a* shows a pair of channels 1103 of increasing width. Each channel 1103 has a portion of narrower width 1103*a* at one end and a portion of greater width 1103*b* at another end. The portion of narrower width 1103*a* of each channel 1103 may be positioned adjacent to feeder bowl 301 to receive items supplied from feeder bowl 301. Depending upon the number of channels 1103 positioned around feeder bowl 301 and the dimensions of each channel 1103, outer edges 1105 of adjacent channels 1103 may contact. In this way, the plurality of channels 1103 may form a continuous item-dispensing surface extending from a periphery of feeder bowl 301 to receive a plurality of items supplied by feeder bowl 301.

Figure 11B:
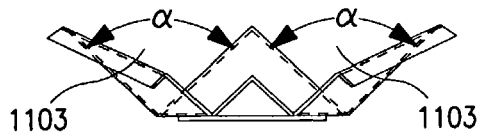
FIG. 11*b* shows an end view of the channel of FIG. 11*a*, according to the present invention
Figure 11C:
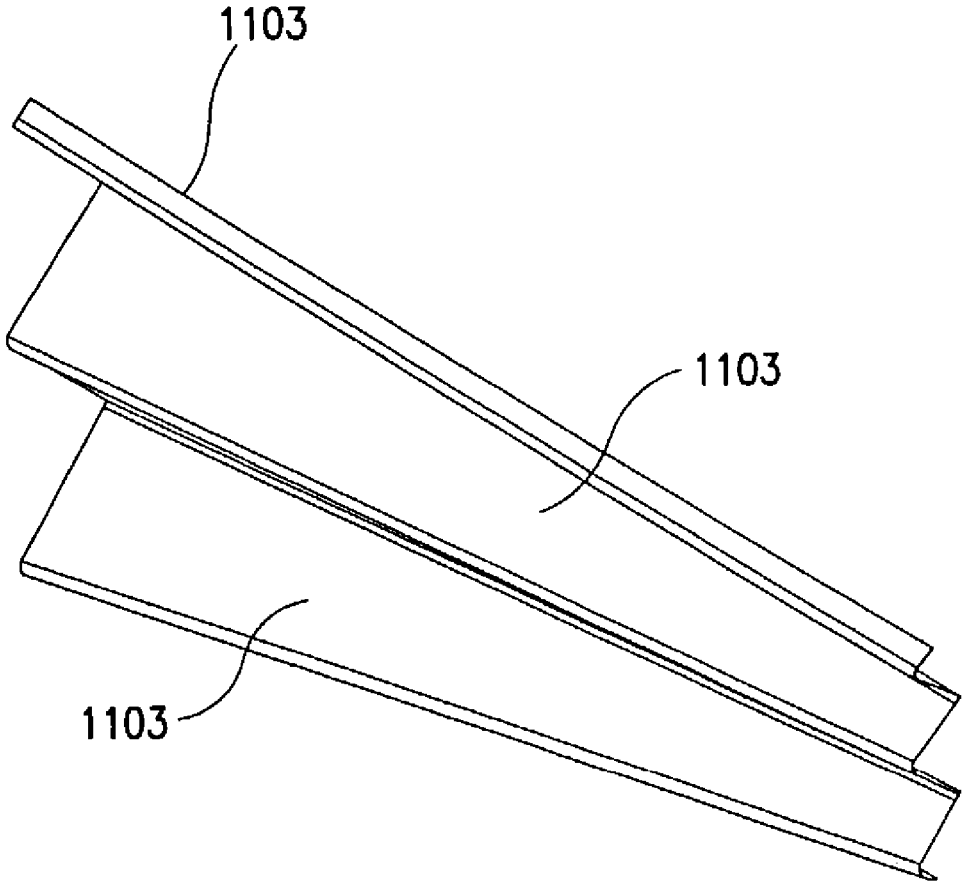
FIG. 11*c* shows a perspective view of the channel of FIG. 11*a*, according to the present invention.

Each channel 1103 may have a substantially V-shaped cross-section, such that a pair of channels 1103 may have a substantially W-shaped cross-section, as shown in FIGS. 11*b* and 11*c*. Each channel may have a U-shaped, so that a pair of such channels has a double-U-shaped cross-sectional configuration. Further, a depth of each channel 1103 may increase as each channel 1103 extends from a portion of narrower width 1103*a* to a portion of greater width 1103*b*, as shown in FIG. 11*c*. Thus, a depth of each channel 1103 may increase as each channel 1103 extends radially from a periphery of feeder bowl 301.

The angle of offset $\alpha$ of adjacent sides of a channel 1103 may vary, as well. For example, the angle of offset $\alpha$ may be about 90°, as shown in FIG. 11*b*. However, the angle of offset $\alpha$ may be an acute angle or an obtuse angle, depending upon a physical characteristic, e.g., a weight, a volume, a density, or the like, of items to be dispensed. The cross-sectional configuration, depth, and angle of offset $\alpha$ of each channel 1103 may vary according to a physical characteristic of items to be dispensed, so that each channel 1103 may receive a plurality of items supplied by feeder bowl 301, sort the items into a single file as the items travel along each channel 1103, and dispense the items singularly from a distal end of each channel 1103 to improve the accuracy of a count or a measurement or both of each dispensed item.

In another embodiment of the invention, each channel 603 may be arc-shaped and extend in an arc-shaped pattern from a periphery of feeder bowl 301, as shown in FIG. 6. A width of each channel may increase as each channel extends from feeder bowl 301. A depth of each channel may increase as each channel extends from feeder bowl 301. Each channel may have a substantially V-shaped cross-sectional configuration or a substantially U-shaped cross-sectional configuration.

In an embodiment in which a dispensing path 302 includes a pair of item-dispensing channels, the pair of channels may have a substantially W-shaped cross-sectional configuration or a substantially double-U-shaped cross-sectional configuration. The cross-sectional configuration, depth, and angle of offset of each channel may vary according to a physical characteristic of each item to be dispensed, so that each arc-shaped channel may receive a plurality of items supplied by feeder bowl 301, sort the items into single file as the items travel along each channel, and dispense the items singularly from a distal end of each channel to improve the accuracy of a count or a measurement or both of each dispensed item.

As shown in FIGS. 3 and 4, a bulk delivery apparatus 306, may deliver items to rotary, vibratory dispenser 300. Bulk delivery apparatus 306, 403 may be positioned adjacent to rotary, vibratory dispenser 300, as shown in FIGS. 3 and 4, to deliver items to rotary, vibratory dispenser 300, e.g., to feeder bowl 301 of rotary, vibratory dispenser 300. Bulk delivery apparatus 306 may include a bulk delivery drive 306*a*, e.g., a vibration device, a motor, or the like, for controlling a rate of delivery of items from bulk delivery apparatus 106 to rotary, vibratory dispenser 100. Adjustment of bulk delivery drive 306*a* enables adjustment of the rate of delivery of items from bulk delivery apparatus 306.

As shown in FIGS. 3 and 4, bulk delivery apparatus 306 may include a hopper 306 and a hopper vibration device 306*a* for vibrating hopper 306, so that items may be delivered at different rates to feeder bowl 301 of rotary, vibratory dispenser 300. Such hopper vibration devices 306*a* may include Syntron® Electromagnetic Vibrators, which are available from FMC Technologies Material Handling Solutions of Homer City, Pa. Other hoppers 306 and hopper vibration devices 306*a* may include the Skako Comassa Feeders, which are available from Skako, Inc. of Faaborg, Denmark.

In another embodiment of the invention, bulk delivery apparatus 306 may include a conveyor or the like for delivering items to feeder bowl 301 of rotary, vibratory dispenser 300.

In a further embodiment of the invention, the rate of delivery of items from bulk delivery apparatus 306 to rotary, vibratory dispenser 300 may be regulated by adjusting an aperture, or the like, of bulk delivery apparatus 306.

Bulk delivery apparatus 306 may include a sensing unit 306*b*, for counting or measuring items delivered from bulk delivery apparatus 306 to feeder bowl 301. Sensing unit 306*b* may include a scale, e.g., a strain gauge, for weighing items in bulk delivery apparatus 306 and for determining a weight of items delivered from bulk delivery apparatus 306 to feeder bowl 301 in a given time period. Sensing unit 306*b* may include one or more optic sensors, infrared sensors, electromagnetic radiation sensors, proximity sensors, capacitative sensors, or the like, such as are available from IFM Efector, Inc., Exton, Pa. Sensing unit 306*b* may be positioned at bulk delivery apparatus 306 to count, e.g., to sense or the like, items dispensed from bulk delivery apparatus, so that bulk delivery apparatus 306 may deliver items to rotary, vibratory dispenser 300 at a rate sufficient to enable rotary, vibratory dispenser 300 to dispense a predetermined number of items to containers or the like at a predetermined rate, e.g., at a predetermined number of containers per minute, or the like.

Feeder bowl rotation drive 307 may rotate feeder bowl 301 at a variety of rotational speeds. In an embodiment of the invention in which feeder bowl 301 and each dispensing path 302 may be positioned on a common rotatable frame 307, as shown in FIGS. 3 and 4, feeder bowl rotation drive 303 may rotate rotatable frame 305 and thus feeder bowl 301 and dispensing paths 302 at a rotational speed that may correspond to a predetermined rate of filling containers at rotary, vibratory dispenser 300.

For example, if rotary, vibratory dispenser 300 includes 48 dispensing paths 302 and each dispensing path 302 includes two item-dispensing channels, and rotary, vibratory dispenser 300 must fill 480 containers per minute, feeder bowl rotation drive 307 may rotate feeder bowl 301 and dispensing paths 302 at five (5) revolutions per minute (rpm), so that rotary, vibratory dispenser 300 may dispense items to 480 containers per minute. If each dispensing path 302 includes a single item-dispensing channel, rotation drive 307 may rotate feeder bowl 301 and dispensing paths 302 at ten (10) ten rpm, so that rotary, vibratory dispenser 300 may dispense items to 480 containers per minute.

According to an embodiment of the present invention in which dispensing paths 302 may rotate independently of feeder bowl 301, feeder bowl rotation drive 307 may rotate each dispensing path 302 at a substantially similar rotational speed as feeder bowl 301, or feeder bowl rotation drive 307 may rotate each dispensing path 302 at a rotational speed that is greater than or less than feeder bowl 301, e.g., via a transmission (not shown), so that a rotational speed of dispensing paths 302 may be varied relative to a rotational speed of feeder bowl 301. In a further embodiment of the invention, feeder bowl rotation drive 307 may rotate dispensing paths 302 in a direction of rotation that is opposite to a direction of rotation of feeder bowl 301. In each of these embodiments, feeder bowl rotation drive 307 may rotate dispensing paths 302 at a rotational speed that corresponds to a predetermined rate of filling containers at rotary, vibratory dispenser 300.

Feeder bowl vibration device 308 may vibrate feeder bowl 301 at different vibrational settings, e.g., at different vibrational magnitudes, at different vibrational frequencies, or both, so that feeder bowl 301 may supply items uniformly to each dispensing path 302. Feeder bowl vibration device 308 may vibrate feeder bowl 301 at different vibrational settings in a first plane, in a second plane, or both. First plane may be a substantially horizontal plane, while second plane may be a substantially vertical plane. Alternatively, first plane and second plane may be transverse to one another. Such feeder bowl vibration devices 308 may include Syntron® Electromagnetic Vibrators, which are available from FMC Technologies Material Handling Solutions of Homer City, Pa.

Feeder bowl vibrational settings may be proportionate to a physical characteristic, e.g., a density, a volume, a weight, a temperature, or the like, of items to be supplied by feeder bowl 301 to dispensing paths 302. Feeder bowl vibrational settings may correspond to one or more of a rate of delivery of items to feeder bowl 301, a rotational speed of feeder bowl 301, and a predetermined rate of supplying items from feeder bowl 301 to dispensing paths 302, so that feeder bowl 301 may receive a plurality of items, e.g., from bulk delivery apparatus 306, and supply items uniformly to each dispensing path 302.

Feeder bowl rotation drive 307 may rotate feeder bowl 301 and feeder bowl vibration device 308 may vibrate feeder bowl 301 at various combinations of rotational speeds and vibrational settings, so that feeder bowl 301 may receive items delivered at varying rates, e.g., from a bulk delivery apparatus 306, and dispense the items uniformly to each dispensing path 302. By varying the rotational speed of feeder bowl rotation drive 307 and the vibrational setting of feeder bowl vibration device 308, feeder bowl 301 may receive and supply greater quantities of items uniformly to dispensing paths 302 than known dispensers, thereby improving the dispensing rate of rotary, vibratory dispenser 300 over such known dispensers.

Dispensing path vibration devices 309 may vibrate each dispensing path 302 and associated item-dispensing channel. Dispensing path vibration devices 309 may vibrate each dispensing path 302 and channel at different vibrational settings, e.g., at different vibrational frequencies, at different vibrational magnitudes, or both. Moreover, each dispensing path vibration device 309 may vibrate each dispensing path 302 and channel at different vibrational settings in a first plane, or a second plane, or both. First plane may be substantially horizontal, while second plane may be substantially vertical, or first plane and second plane may be transverse. Such dispensing path vibration devices 309 may include Syntron® Solid Mount Linear Drives, which are available from FMC Technologies Material Handling; Solutions of Homer City, Pa.

Each dispensing path vibration device 309 may vibrate one or more respective dispensing paths 302 proportionately to a physical characteristic e.g., a density, a volume, a weight, a temperature, a physical dimension, or the like, of each item. Moreover, each dispensing path vibration device 309 may vibrate each dispensing path 302 proportionately to a rate of supply of items from feeder bowl 301 to each dispensing path 302, to a rotational speed of dispensing paths 302, or to a predetermined dispensing rate of each dispensing path 302, so that each dispensing path 302 dispenses items singularly.

A separate dispensing path vibration device 309 may vibrate each dispensing path 302 and associated channel(s) independently of every other dispensing path 302, e.g., at different vibrational settings, and independently of feeder bowl 301. In another embodiment of the invention, each dispensing path vibration device 309 may vibrate two or more dispensing paths 302 and associated channel(s) at similar vibrational settings. If each dispensing path 302 includes two or more item-dispensing channels, a dispensing path vibration device 309 may vibrate two or more channels of a respective dispensing path 302 at a similar vibrational setting, or a dispensing path vibration device 309 may vibrate each channel of a dispensing path 302, e.g., one, two, three, four, or more channels of a respective dispensing path 302 at a similar vibrational settings, e.g., in or along similar vibrational axes, at similar vibrational magnitude, at similar vibrational frequencies, or combinations thereof.

A sensing unit 318 may be positioned at each dispensing head 310, e.g., adjacent to an opening 311 of each dispensing head 310. In alternate embodiments, a sensing unit may be positioned adjacent to each dispensing path 302, e.g., adjacent a distal end of each dispensing path 302 and associated item-dispensing channel. In embodiments of the invention in which a dispensing path 302 may include two or more item-dispensing channels (not shown), a sensing unit may be positioned at each channel, e.g., at a distal end of each channel. In each embodiment, sensing units 316 may measure or count each item, as items are received by dispensing head 310. For example, each sensing unit 316 may measure a physical characteristic, e.g., a volume, a weight, a density, a physical dimension, or the like, of each item dispensed from each dispensing path 302 or channel. Each sensing unit 316 may count each item dispensed from each dispensing path 302 or channel, so that predetermined quantities of items may be dispensed to each container.

A dispensing head 310 may be positioned at each dispensing path 302 to receive items dispensed from a respective dispensing path 302. For example, a dispensing head 310 may be positioned adjacent to each dispensing path 302, e.g., adjacent to a distal end of each dispensing path (in embodiments of the present invention in which each dispensing path includes a single item-dispensing channel). In embodiments of the invention in which a dispensing path 302 may include two or more item-dispensing channels, a dispensing head 310 may be positioned adjacent to each channel, e.g., at a distal end of each channel of a dispensing path 302. Each dispensing head 310 may include an opening 311 for receiving items dispensed from each dispensing path 302 or channel. Dispensing head 310 may include a bifurcation device 312 for directing received items to a first chamber 313 or a second chamber 314 of each dispensing head 310. Moreover, each dispensing head 310 may include a holding chamber 315. Holding chamber 315 may be positioned at a lower portion of dispensing head 310. Holding chamber 315 may comprise a pair of doors 316, 317 that may be configured to direct items in a first direction, e.g., toward a container or the like, and to divert items in a second direction, e.g., away from a container or the like. In another embodiment of the present invention, holding chamber 315 may include two pair of doors.

Referring to FIGS. 13*a*–13*h*, in a modification of this embodiment of the present invention, holding chamber 315 may be replaced by a first holding chamber 315' and a second holding chamber 315", door 316 may be replaced by a first door 316', and door 317 may be replaced by a guiding wall 317' and a second door 317". First holding chamber 315' may be positioned below second holding chamber 315" and when second door 317" is in a closed position, holding chambers 315' and 315" may form a continuous chamber. Nevertheless, when second door 317" is in an open position, second door 317" may prevent the items from reaching first holding chamber 315'. Specifically, bifurcation device 312 may receive the items which pass through opening 311, such that the items are positioned within first chamber 313 or second chamber 314. When bifurcation device 312 receives a predetermined number of items which have acceptable physical characteristics, e.g., physical characteristics which are within a predetermined range of physical characteristics, bifurcation device 312 may direct the received items into first holding chamber 315' via second holding chamber 315". First door 316' then may move from a closed positioned to an open position, such that the items received by first holding chamber 315' are directed toward the container. Nevertheless, if bifurcation device 312 receives any item which does not have acceptable characteristics, e., physical characteristics which are greater than or less than the predetermined range of physical characteristics, second door 317" may move from the closed position to the open position, and bifurcation device 312 subsequently may direct the received items into second holding chamber 315". When bifurcation device 312 directs the received items into second holding chamber 315", bifurcation device 312 may receive new items, such that the new items may be positioned within first chamber 313 or second chamber 314. Moreover, when the received items reach second holding chamber 315", second door 317" may direct the received items away from the container. Consequently, when bifurcation device 312 receives an unacceptable item, each of the items received by the bifurcation device 312 may be directed away from the container without having to wait for bifurcation device 312 to receive the predetermined number of items. Moreover, the new items may be received by bifurcation device 312 without having to wait for second door 317" to direct the received items away from the container.

Figure 12:
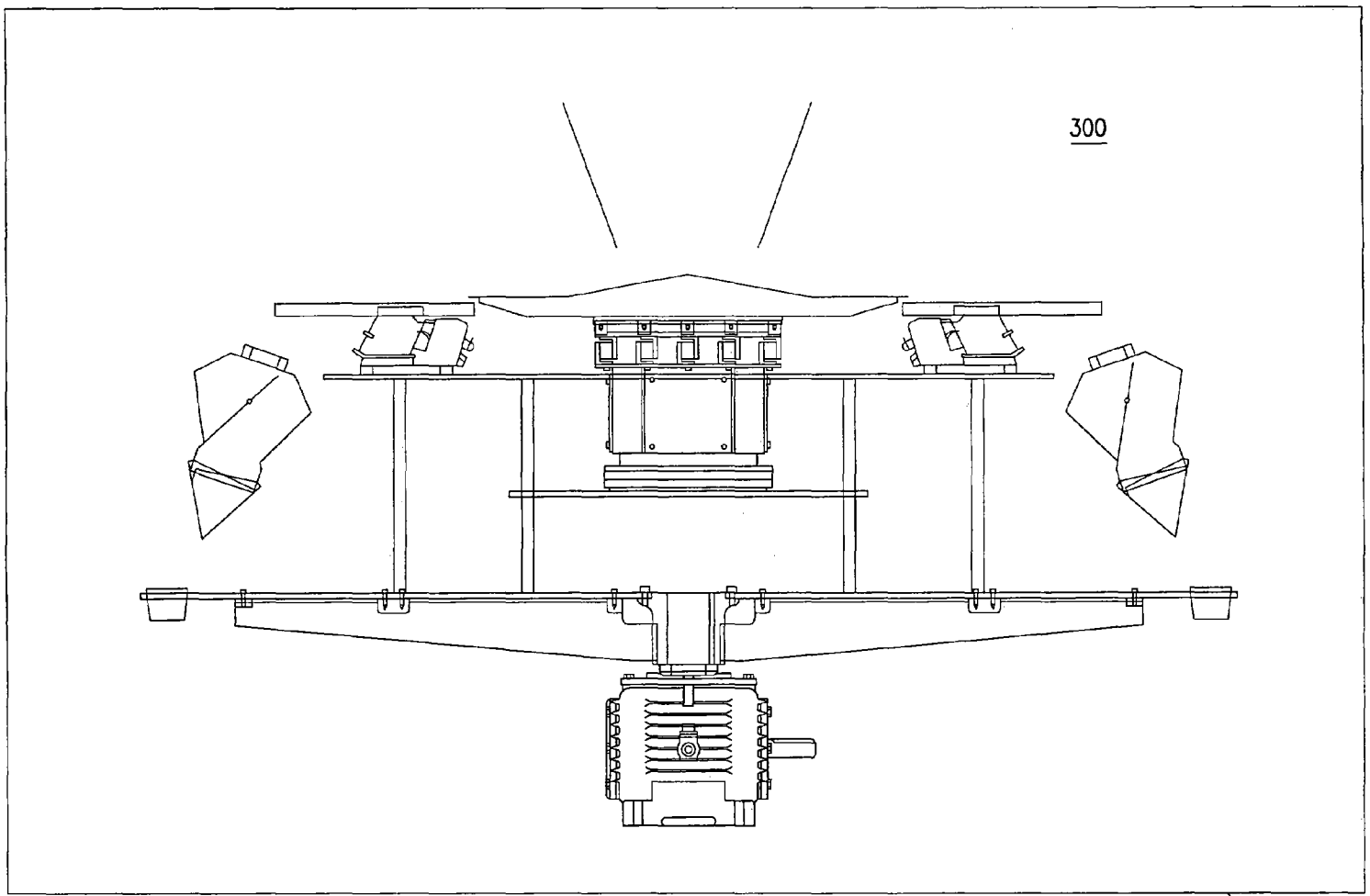
FIG. 12 shows a refrigeration unit for use with the dispenser of the present invention.
Figure 13A:
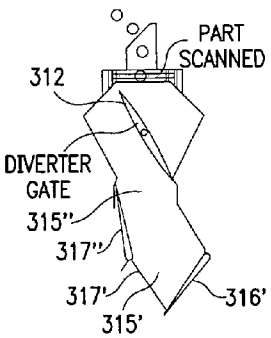
FIGS. 13*a*–13*h* show an operation of a dispensing head according to an embodiment of the present invention.
Figure 13B:
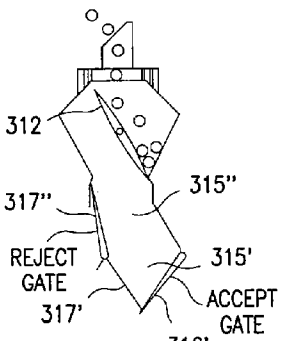
Figure 13C:
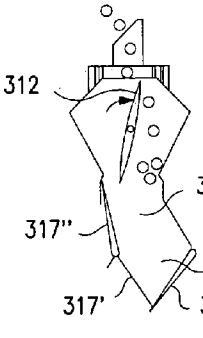
Figure 13D:
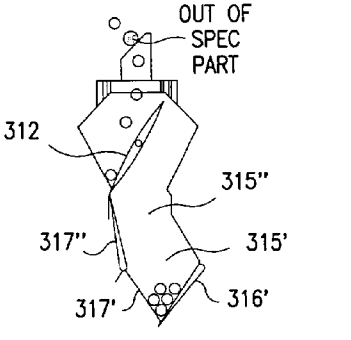
Figure 13E:
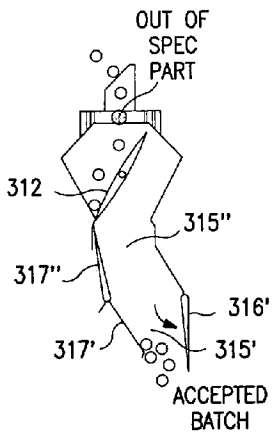
Figure 13F:
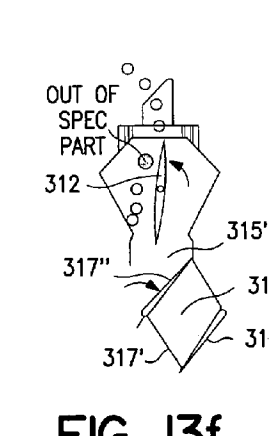
Figure 13G:
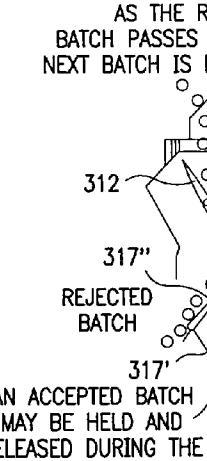
Figure 13H:
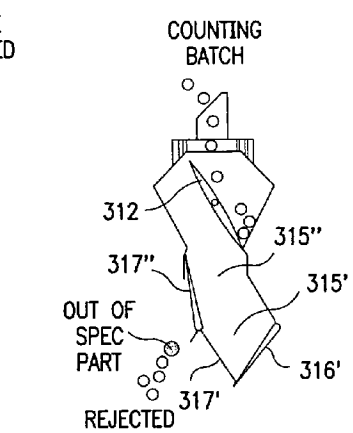

As shown in FIG. 12, the dispensing system and method of the present invention may include a refrigeration unit 1200 for maintaining items at a predetermined temperature. Moreover, refrigeration unit 1200 may provide cooled or chilled air to dispensing station, or refrigeration unit may enclose dispensing station, or bulk delivery apparatus, or both. Refrigeration unit may store items to be dispensed before the items are transferred to bulk delivery apparatus. Refrigeration unit may supply cooled or chilled air to dispensing station, or refrigeration unit may enclose dispensing station, so that each item may be maintained at a temperature of about −3° C. (25° F.) to about 7° C. (45° F.) during operation of dispensing stat In operation, containers may be transported to dispensing station 102, 202 on conveyor 101, 201. As containers approach dispensing station 102, 202, spacing mechanism 103, 203, e.g., timing screw 207, may engage each container and progressively space containers to a predetermined pitch as containers are conveyed to dispensing station 102, 202. A container-receiving groove 111, 211 of transfer wheel 104, 204 engages each container, so that transfer wheel 104, 204 may move containers from conveyor 101, 201 to star wheel 105, 205, while maintaining the predetermined pitch of the containers. A container-receiving groove 112, 212 of star wheel 105, 205 engages each container as containers are moved from conveyor 101, 201 to star wheel 105, 205 by transfer wheel 104, 204. Star wheel 105, 205 transports containers through dispensing station in synchronization with dispenser, so that each container may be positioned in alignment with a respective dispensing path, or dispensing head, or both, of dispenser and so that containers may be transported at a rotational speed that is substantially similar to a rotational speed of dispenser.

At dispensing station 102, 202, dispenser dispenses items to each container in the following manner. Feeder bowl 301 receives a plurality of items to be dispensed. For example, bulk delivery apparatus 306 may deliver items to feeder bowl 301. Feeder bowl vibration device 308 vibrates feeder bowl 301 and feeder bowl rotation drive 307 rotates feeder bowl 301, so that feeder bowl 301 may supply items uniformly to dispensing paths 302 positioned around feeder bowl 301. Dispensing paths 302 may be positioned around a periphery of feeder bowl 301 to receive items supplied by feeder bowl 301. Dispensing path vibration devices 308 vibrate dispensing paths 302, so that dispensing paths 302 dispense items singularly from a distal end of each dispensing path 302.

A sensing unit 316 may be positioned at each dispensing path 302, e.g., at a distal end of each dispensing path 302, at a distal end of each channel, or the like, to measure a physical characteristic of each item. A dispensing head 310 may be positioned at a distal end of each dispensing path 302 to receive items dispensed singularly from each dispensing path 302. If each dispensing path 302 comprises a plurality of item-dispensing channels (not shown), dispensing head 310 may be positioned at a distal end of each channel to receive items dispensed from each channel. Each dispensing head 310 may direct a predetermined quantity of items, based on a measured count of items by sensing units 316, to each container positioned in alignment with a respective dispensing head 310 by star wheel 105, 205.

Turret 106, 206 receives containers from star wheel 105, 205 and moves containers to conveyor 101, 201. Each container-receiving groove 316, 215 of turret 106, 206 may engage a container, so that turret 106, 206 may move containers from dispensing station 102, 202 to conveyor 101, 201 while maintaining a predetermined pitch of each container. In an alternative embodiment of the invention, a spacing between adjacent container-receiving grooves 316, 215 of turret 106, 206, or a rotational speed of turret 106, 206, or both may be varied, so that turret 106, 206 moves containers to conveyor 101, 201 at a pitch that is greater than or less than a pitch of containers at dispensing station 102, 202. Conveyor 101, 201 then transports containers away from dispensing station 102, 202. Conveyor 101, 201 may transport containers to one or more dispensing stations or to a packaging station, or both.

Figure 7:
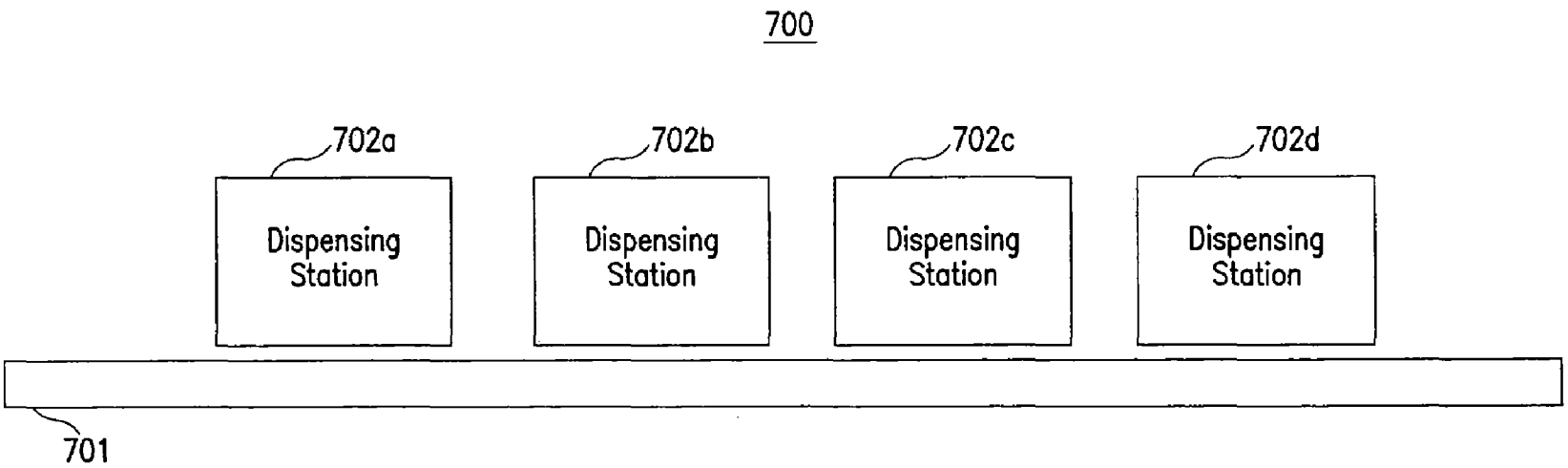
FIG. 7 shows a schematic of a dispensing system including a series of dispensing stations.

Dispensing systems according to other embodiments of the invention may include one or more conveyors that transport containers among a plurality of dispensing stations, so that each container may receive predetermined quantities of items at one or more dispensing station. As shown in FIG. 7, a dispensing system 700 according to an embodiment of the present invention may include a conveyor 701 and a plurality of dispensing stations 702*a*, 702*b*, 702*c*, 702*d*. Conveyor 701 may transport containers (not shown) between a plurality of dispensing stations 702*a*, 702*b*, 702*c*, 702*d*, each of which dispensing stations is positioned in series along conveyor 701, so that each container may be filled progressively with items, e.g., predetermined quantities of items, at each dispensing station 702*a*, 702*b*, 702*c*, 702*d*.

Figure 8:
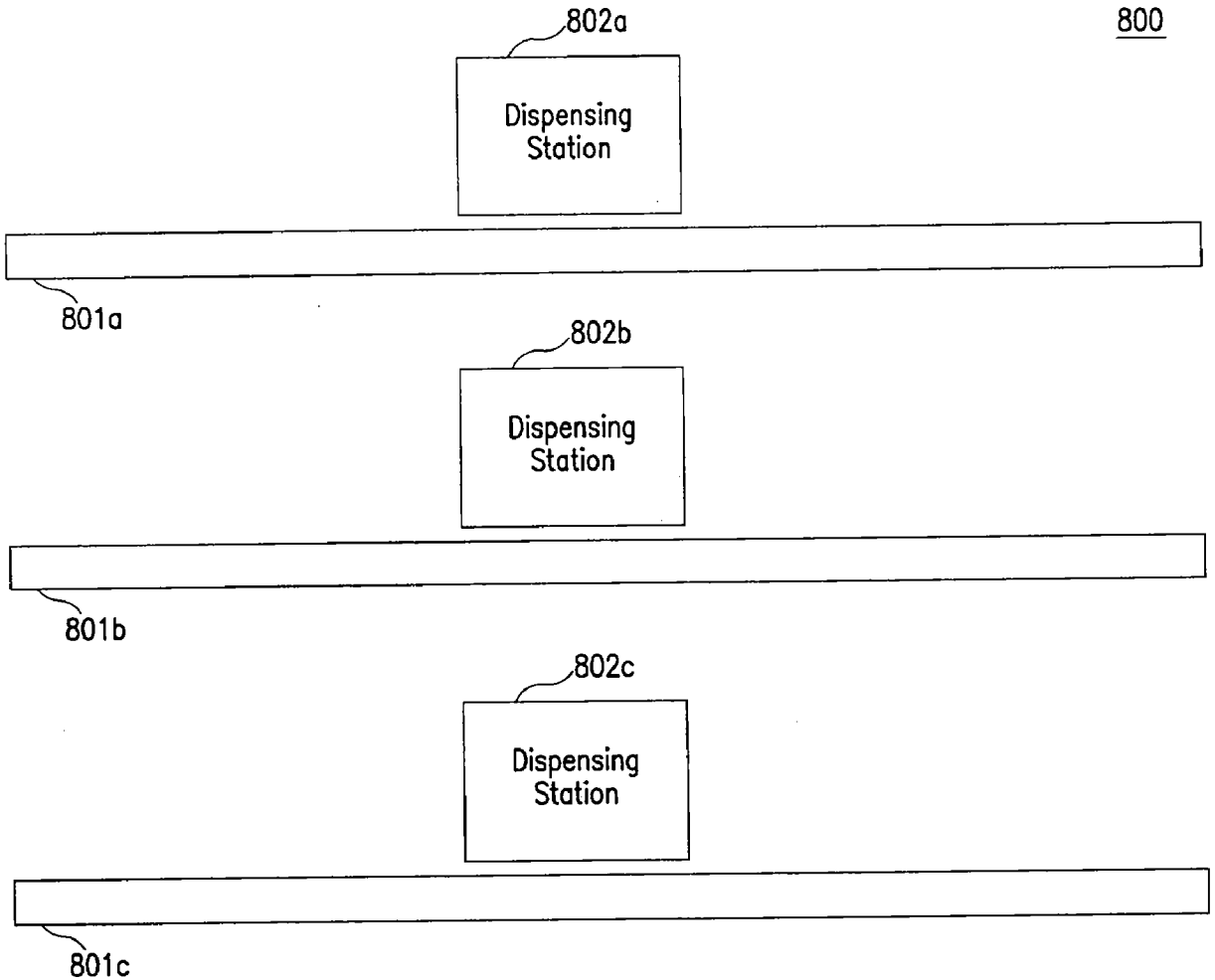
FIG. 8 shows a schematic of a dispensing system including parallel dispensing stations.

As shown in FIG. 8, a dispensing system 800 according to another embodiment of the present invention may include a plurality of conveyors 801*a*, 801*b*, 801*c* and a plurality of dispensing stations 802*a*, 802*b*, 802*c*. Each conveyor 801*a*, 801*b*, 801*c* may transport containers to one of dispensing stations 802*a*, 802*b*, 802*c*, each of which dispensing stations 802*a*, 802*b*, 802*c* may be positioned along one of a plurality of conveyors 801*a*, 801*b*, 801*c*, which may be positioned in parallel, so that a container may filled with items at one of dispensing stations 802*a*, 802*b*, 802*c*, depending upon which conveyor 801*a*, 801*b*, 801*c* transports each container.

Figure 9:
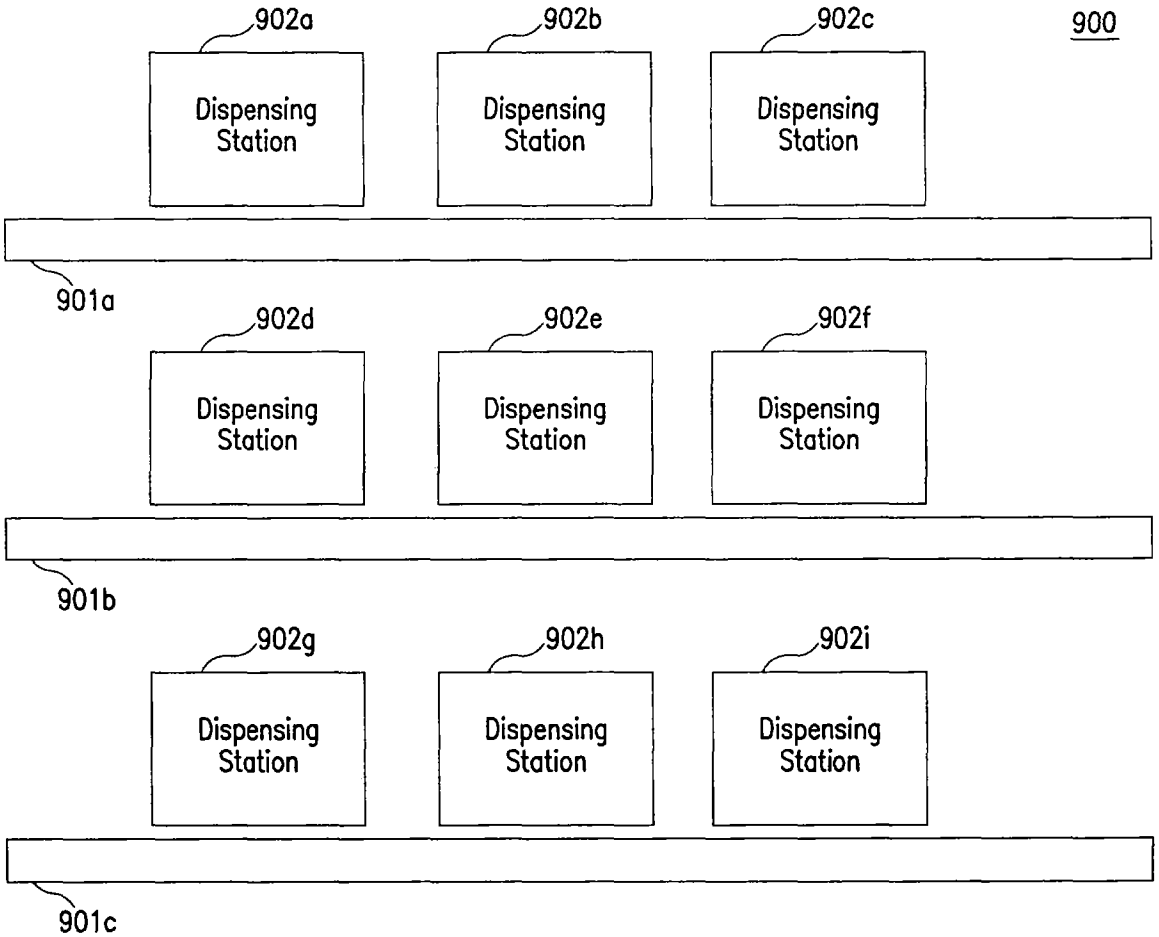
FIG. 9 shows a schematic of a dispensing system including series and parallel dispensing stations.

As shown in FIG. 9, a dispensing system 900 according to a still further embodiment of the present invention may include a plurality of conveyors 901*a*, 901*b*, 901*c* and a plurality of dispensing stations 902*a–i*. Each conveyor 901*a*, 901*b*, 901*c* may transport containers among a plurality of dispensing stations 902*a–i*, which may be positioned in series along one of a plurality of conveyors 901*a*, 901*b*, 901*c* that may be positioned in parallel, so that containers may be filled progressively with items at respective dispensing stations 902*a–i* positioned in series along one of the parallel conveyors 901.

Figure 14:
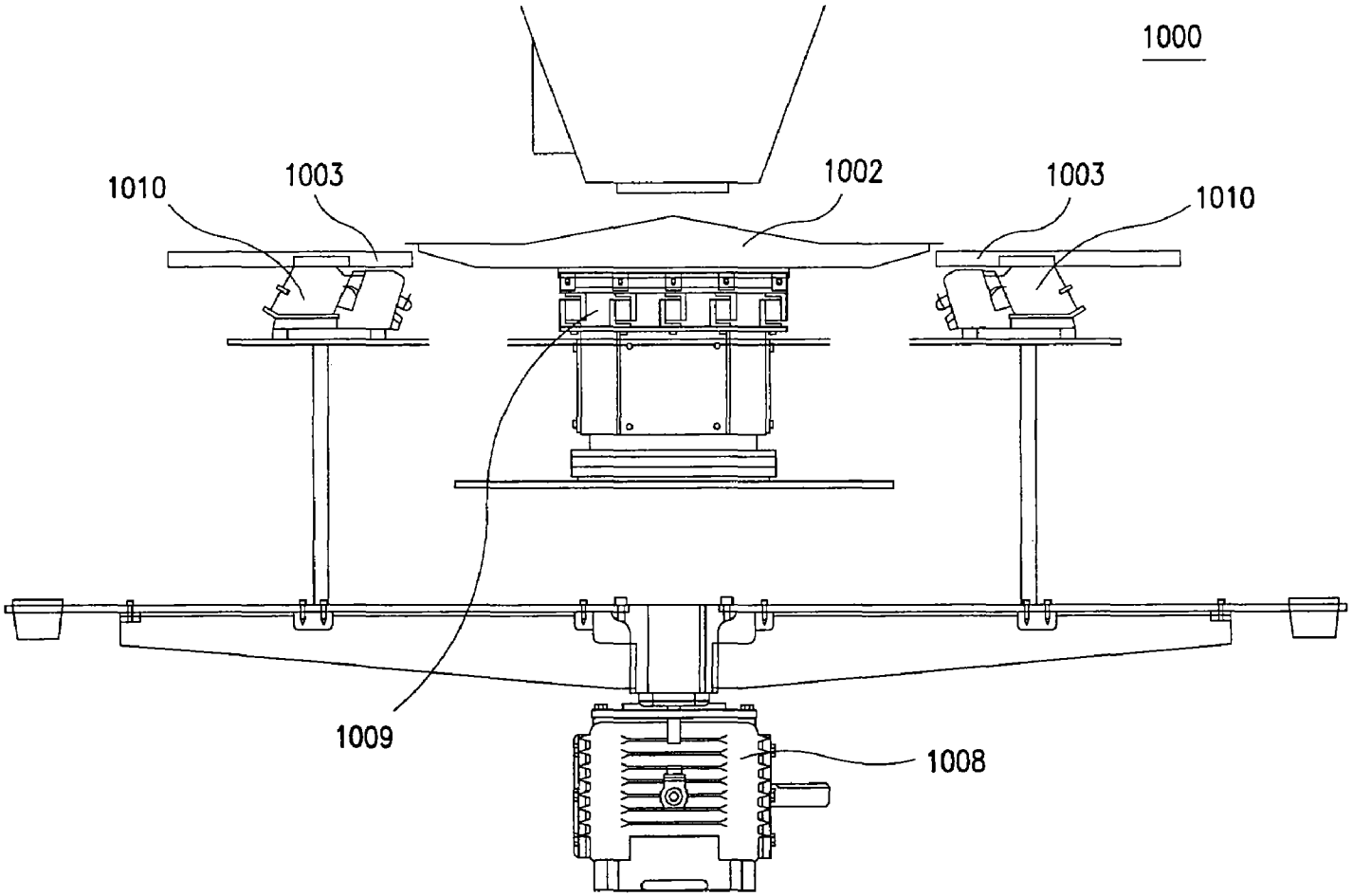
FIG. 14 shows a side view of a dispenser according to yet another embodiment of the present invention.

Referring to FIG. 14, a dispenser 1000 according to another embodiment of the present invention is depicted. The features and advantages of dispenser 1000 are substantially similar to the features and advantages of dispensers 100, 200, 300, 700, 800, and 900. Therefore, the similar features and advantages of dispensers 100, 200, 300, 700, 800, 900, and 1000 are not discussed further with respect to dispenser 1000. Dispenser 1000 may comprise a feeder bowl 1002, one or more dispensing paths 1003 positioned around feeder bowl 1002, a dispensing path rotation drive 1008 for rotating dispensing paths 1003, a feeder bowl vibration device 1009 for vibrating feeder bowl 1002, and one or more dispensing path vibration devices 1010 for vibrating each dispensing path 1003. In this embodiment of the present invention, feeder bowl vibration device 1009 may vibrate feeder bowl 1002, the one or more dispensing path vibration devices 1010 may vibrate dispensing paths 1003, and dispensing path rotation drive 1008 may rotate dispensing paths 1003 around feeder bowl 1002. For example, an edge of dispensing paths 1003 may be positioned below and may overlap a portion of feeder bowl 102, such that at least one vertical plane includes both dispensing paths 103 and feeder bowl 1002. Moreover, in this embodiment of the present invention, feeder bowl 1002 does not rotate. Consequently, a lighter motor may be used, there are fewer moving parts is dispenser 1000, and dispenser 1000 may have increased control.

While the invention has been described in connection with preferred embodiments, it will be understood by those of ordinary skill in the art that other variations and modifications of the preferred embodiments described above may be made without departing from the scope of the invention. Moreover, other embodiments of the present invention will be apparent to those of ordinary skill in the art from a consideration of the specification or a practice of the invention disclosed herein, or both.

What is claimed is:

1. A system for dispensing items comprises:

a first dispensing station; and a first conveyor for transporting containers to said dispensing station, wherein said first dispensing station comprises:

a dispenser for directing items to said containers;

a mechanism for spacing said containers to a predetermined pitch;

a transfer wheel for removing said containers from said first conveyor;

a star wheel for receiving said containers from said transfer wheel and for positioning said containers in alignment with said dispenser; and a turret for removing said containers from said star wheel.

2. The system of claim 1, wherein said dispenser comprises a rotary, vibratory dispenser comprising:

a feeder bowl for receiving a plurality of items to be dispensed;

a feeder bowl vibration device for vibrating said feeder bowl;

a feeder bowl rotation drive for rotating said feeder bowl;

a plurality of dispensing paths positioned around said feeder bowl; and at least one dispensing path vibration device for vibrating each of said dispensing paths proportionately to a physical characteristic of each of said items, wherein said feeder bowl vibration device vibrates said feeder bowl and said feeder bowl rotation drive rotates said feeder bowl, so that said feeder bowl supplies items uniformly to said dispensing paths and wherein said at least one dispensing path vibration device vibrates said dispensing paths, so that said dispensing paths dispense said items singularly, wherein said feeder bowl rotation drive rotates said dispensing paths.

3. The system of claim 2, further comprising:

a dispensing head positioned at a distal end of each of said dispensing paths for receiving said singularly-dispensed items, wherein each of said dispensing heads may direct predetermined quantities of items to a container or divert predetermined quantities of items away from a container.

4. The system of claim 3, wherein said star wheel comprises a plurality of second grooves and wherein each of said plurality of second grooves positions one of said containers in alignment with a respective dispensing head.

5. The system of claim 3, wherein said dispensing heads rotate with said feeder bowl and wherein said star wheel transports each of said containers in synchronization with a respective one of said dispensing heads to receive said predetermined quantity of items.

6. The system of claim 3, wherein said star wheel transports each of said containers at a rotational speed that is substantially similar to a rotational speed of said dispensing heads.

7. The system of claim 1, wherein said dispenser comprises a vibratory dispenser comprising:

a feeder bowl for receiving a plurality of items to be dispensed;

a feeder bowl vibration device for vibrating said feeder bowl;

a plurality of dispensing paths positioned around said feeder bowl;

at least one dispensing path vibration device for vibrating each of said dispensing paths proportionately to a physical characteristic of each of said items; and a dispensing path rotation drive for rotating said dispensing paths, wherein said feeder bowl vibration device vibrates said feeder bowl, such that said feeder bowl supplies items uniformly to said dispensing paths, and wherein said at least one dispensing path vibration device vibrates said dispensing paths, and said dispensing path rotation drive rotates said dispensing paths, such that said dispensing paths dispense said items singularly.

8. The system of claim 7, further comprising:

a bulk delivery apparatus for dispensing said items to said feeder bowl.

9. The system of claim 7, further comprising:

a control unit for controlling a rotational speed of said rotation drive and a vibration of said feeder bowl vibration device and said at least one dispensing path vibration device, so that said dispensing paths dispense said items singularly.

10. The system of claim 1, wherein said first conveyor receives said containers from said turret and transports said containers from said first dispensing station to a packaging station.

11. The system of claim 1, further comprising:

a plurality of dispensing stations, wherein said plurality of dispensing stations are positioned in series along said first conveyor and wherein said first conveyor transports said containers from said first dispensing station to each of said plurality of dispensing stations.

12. The system of claim 1, further comprising:

a plurality of dispensing stations, wherein said plurality of dispensing stations are positioned in series along parallel portions of said first conveyor and wherein said first conveyor transports said containers from said first dispensing station to each of said plurality of dispensing stations.

13. The system of claim 1, wherein said spacing mechanism is positioned adjacent to said first conveyor, so that said spacing mechanism spaces said containers to a predetermined pitch as said first conveyor transports said containers to said dispensing station.

14. The system of claim 13, wherein said transfer wheel is positioned adjacent to said first conveyor, wherein said transfer wheel comprises a plurality of first grooves for engaging each of said containers and moving said containers to said star wheel, and wherein a spacing between adjacent ones of said first grooves of said transfer wheel maintains said predetermined pitch of said containers.

15. The system of claim 1, wherein said spacing mechanism comprises a timing screw comprising a series of helical ribs for engaging and spacing each of said containers to said predetermined pitch.

16. The system of claim 15, wherein a width of each of said helical ribs increases progressively as said ribs are positioned along a longitudinal axis of said timing screw, so that said infeed timing screw progressively spaces said containers to said predetermined pitch.

17. The system of claim 1, wherein said star wheel comprises a plurality of second grooves and wherein a spacing between adjacent second grooves of said star wheel maintain said predetermined pitch of said containers.

18. The system of claim 1, wherein said transfer wheel comprises a plurality of first grooves for engaging said containers and moving said containers to said star wheel.

19. The system of claim 1, wherein said star wheel comprises a plurality of second grooves for engaging and conveying said containers through said dispensing station.

20. The system of claim 19, further comprising:

an arcuate guard rail positioned adjacent to said star wheel for maintaining each of said containers within a respective one of said second grooves.

21. The system of claim 19, wherein said plurality of second grooves comprises a range of about twelve (12) second grooves to about one hundred (100) second grooves.

22. The system of claim 1, wherein said star wheel transports a range of about four hundred and eighty (480) containers per minute to about one thousand (1,000) containers per minute through said dispensing station.

23. The system of claim 1, further comprising:

at least one base segment positioned beneath said star wheel for supporting said containers as said star wheel transports said containers through said dispensing station.

24. The system of claim 1, wherein said turret transfers said containers to said first conveyor.

25. The system of claim 1, wherein said turret comprises a plurality of third grooves for maintaining said pitch of said containers.

26. The system of claim 1, wherein said turret and said transfer wheel are located adjacent to said first conveyor.

27. The system of claim 1, further comprising:

at least one drive for rotating each of a timing screw, said transfer wheel, said star wheel, and said turret; and a control unit, wherein said control unit controls said at least one drive, so that said at least one drive rotates each of said timing screw, said transfer wheel, said star wheel, and said turret, such that said containers move continuously to and through said dispensing station.

* * * * *